US007377619B2

(12) United States Patent
Takahashi et al.

(10) Patent No.: US 7,377,619 B2
(45) Date of Patent: May 27, 2008

(54) PRINTING APPARATUS AND PRINTING METHOD

(75) Inventors: Kiichiro Takahashi, Kawasaki (JP); Naoji Otsuka, Yokohama (JP); Osamu Iwasaki, Tokyo (JP); Minoru Teshigawara, Yokohama (JP); Tetsuya Edamura, Kawasaki (JP); Naomi Oshio, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 302 days.

(21) Appl. No.: 11/114,167

(22) Filed: Apr. 26, 2005

(65) Prior Publication Data

US 2005/0243126 A1 Nov. 3, 2005

(30) Foreign Application Priority Data

Apr. 30, 2004 (JP) ..... 2004-136675

(51) Int. Cl.
*B41J 2/21* (2006.01)

(52) U.S. Cl. ..... 347/43

(58) Field of Classification Search ..... 347/43
See application file for complete search history.

(56) References Cited

U.S. PATENT DOCUMENTS

| | | | | |
|---|---|---|---|---|
| 5,208,605 | A * | 5/1993 | Drake | 347/15 |
| 5,764,254 | A * | 6/1998 | Nicoloff et al. | 347/43 |
| 5,883,644 | A * | 3/1999 | Nicoloff et al. | 347/12 |
| 5,975,679 | A * | 11/1999 | Nicoloff et al. | 347/43 |
| 6,033,055 | A | 3/2000 | Nagoshi et al. | |
| 6,467,870 | B2 * | 10/2002 | Matsumoto et al. | 347/19 |
| 6,755,506 | B2 | 6/2004 | Nishikori et al. | |
| 6,964,467 | B2 | 11/2005 | Kaneko et al. | |
| 2002/0030717 | A1 * | 3/2002 | Ishikura | 347/43 |
| 2002/0109752 | A1 * | 8/2002 | Sato | 347/43 |
| 2002/0149666 | A1 * | 10/2002 | Amada et al. | 347/233 |
| 2003/0090539 | A1 * | 5/2003 | Lahut et al. | 347/43 |
| 2004/0021734 | A1 * | 2/2004 | Otsuki | 347/43 |

FOREIGN PATENT DOCUMENTS

| | | |
|---|---|---|
| JP | 7-186411 | 7/1995 |
| JP | 8-258291 | 10/1996 |

OTHER PUBLICATIONS

Counterpart U.S. patent also cited (see text of IDS).

* cited by examiner

*Primary Examiner*—Lamson Nguyen
*Assistant Examiner*—Justin Seo
(74) *Attorney, Agent, or Firm*—Fitzpatrick, Cella, Harper & Scinto

(57) ABSTRACT

This invention provides a printing apparatus which employs a print head constructed to minimize a memory area to hold ejection data and not requiring a sophisticated manufacturing technology and thus realizes a print mode to perform a higher-than-normal-resolution printing, making it possible to form a high quality image when needed. For each of cyan and magenta that make large contributions to the formation of an image, four nozzle arrays are allocated. For each of the remaining colors, two nozzle arrays are allocated. For cyan and magenta, the interval between adjoining nozzles of the paired two arrays is set to ¼ the nozzle pitch. For cyan and magenta, all of the four nozzle arrays are used in the high resolution print mode and, in the normal print mode, only two of the four nozzle arrays are used for printing. Of the paired adjoining nozzle arrays, only one is used.

11 Claims, 21 Drawing Sheets

| FIG.8A |
| --- |
| FIG.8B |

NORMAL PRINT MODE

HIGH RESOLUTION PRINT MODE

PRINTING APPARATUS AND PRINTING METHOD

BACKGROUND OF THE INVENTION

1. Field of the Invention

The present invention relates to a printing apparatus and a printing method using the printing apparatus and more particularly to a printing apparatus and a printing method which use a print head having a plurality of print elements or nozzles which are arranged to differ in nozzle array number and nozzle interval according to a colorant to be ejected.

2. Description of the Related Art

As personal computers, word processors and facsimiles have come into widespread use in offices and homes in recent years, increasing varieties of printing apparatus are being proposed as information output devices for these equipment. Of these, ink jet printers can relatively easily deal with a color printing using a plurality of different inks. The ink jet printing apparatus has many advantages, such as small operation noise, a capability of printing high quality images on a variety of kinds of print mediums and small size. This type of printer therefore is suited for office and home use. Of the ink jet printing apparatus, a serial type printing apparatus, that scans a print head over a print medium to print an image, is in wide use today because of its ability to form high quality images at low cost.

For the low-cost serial type printing apparatus, however, there is a growing demand for an enhanced printing performance. Representative factors of printing performance include image quality and printing speed.

One factor determining an image quality is a kind of ink. Generally, a high quality printing can be achieved by increasing the number of inks used and selecting appropriate kinds of inks. The kind of ink can be distinguished by colorant used in ink, ink color, ink density and others. Among coloring materials for use in ink are, for instance, dye ink and pigment ink. As for the density, there are dark and light inks. As for the ink color, there are orange, red and blue as well as three primary colors for printing of cyan, magenta and yellow.

For example, a well-known printer uses six kinds of inks, such as a dye black ink, a dye yellow ink, dark and light dye magenta inks, and dark and light dye cyan inks, and another uses four kinds of inks, such as a pigment black ink, a dye yellow ink, a dye magenta ink and a dye cyan ink. The former is intended to output with high quality a photographic image from a digital camera or scanner on a glossy print medium and the latter is intended to output with high quality black characters of documents and black lines of tables on plain paper.

Another factor that determines a printed image quality is a resolution. Generally, printing at a higher resolution tends to enhance the quality of printed image. For example, in the case of black characters, printing at a high resolution smoothes edge portions resulting in a higher quality of printed image. In the case of color images, too, the number of grayscale levels that can be represented in one pixel is one of factors determining the image quality. A higher resolution can realize a greater number of tones for one pixel, producing a higher quality of printed image.

Thus, even with two printing apparatus that use the same combination of inks for printing, printed results may differ if the resolutions are different. Realizing a higher resolution is important in producing a higher quality of printed resulted.

Inventions have been made concerning print heads capable of dealing with a plurality of resolutions. Japanese Patent Application Laid-open No. 7-186411 (1995) discloses an ink jet printer with a print head having a plurality of print resolutions. This print head has different resolutions for monochrome printing and color printing, with a resolution for black ink set higher than those of color inks. In a printed document having a combination of texts and images, a black component that appears most frequently in a text part of the document is printed at a high resolution to improve the overall quality of a printed image.

Japanese Patent Application Laid-open No. 8-258291 (1996) discloses an invention about a print head that ejects ink droplets of different dot sizes corresponding to a plurality of resolutions. The technique disclosed here combines small black ink dots and large color ink dots in many ways as the print head ejects ink.

In an ink jet printing apparatus, printing at a higher resolution means an increased number of ink dots that can be printed in a predetermined area. Therefore, where the printing apparatus uses many ink colors and ink kinds, if a high-resolution printing is performed for all ink colors, a huge volume of data needs to be handled. As a result, a storage area to hold ejection data and other associated information becomes necessarily large, requiring a large memory capacity in the printing apparatus, which in turn raises the cost of apparatus. Furthermore, the time taken to map the ejection data and the time required to transfer the data to a head driver increase, raising a variety of problems, such as an increased manufacturing cost of the printing apparatus and a prolonged printing time.

In the print head manufacturing technology, as the print resolution increases, an interval between nozzles making up the print head must be reduced. However, manufacturing the nozzles at a higher density requires a sophisticated manufacturing technology and a faulty product occurrence probability increases. This means that manufacturing a print head integrated with a high density of nozzles itself will result in an increase in the production cost.

SUMMARY OF THE INVENTION

An object of this invention is to provide a printing apparatus and a printing method which employ a print head constructed to minimize a memory area to hold ejection data and not requiring a sophisticated manufacturing technology and thus realize a print mode to perform a higher-than-normal-resolution printing, making it possible to form a high quality image when needed.

First aspect of the present invention provides a printing apparatus for forming an image on a print medium by scanning a print head over the print medium in a scan direction different from the nozzle arrangement direction to apply a plurality of colorants to the print medium; wherein the print head has a plurality of nozzle arrays arranged in the scan direction, two or more of the nozzle arrays being allocated to each of the colorants, the number of nozzle arrays allocated to one colorant differing depending on the colorant, each of the nozzle array having a plurality of nozzles arrayed at a predetermined pitch; wherein the nozzle arrays are arranged so that an interval between the nozzles in the nozzle arrays allocated to one and the same colorant vary from one colorant to another.

Second aspect of the present invention provides a printing method using a printing apparatus, wherein the printing apparatus forms an image on a print medium by scanning a print head over the print medium in a scan direction different from the nozzle arrangement direction to apply a plurality of colorants to the print medium; wherein the print head has a plurality of nozzle arrays arranged in the scan direction, two or more of the nozzle arrays being allocated to each of the colorants, the number of nozzle arrays allocated to one colorant differing depending on the colorant, each of the nozzle array having a plurality of nozzles arrayed at a predetermined pitch; wherein the nozzle arrays are arranged so that an interval between the nozzles in the nozzle arrays allocated to one and the same colorant vary from one colorant to another;

the printing method comprising:

a mode selection step to switch between a first print mode and a second print mode for performing a higher resolution printing than the first print mode; and a nozzle drive control step to control operations of the nozzles according to the mode selected by the mode selection step; wherein, for the colorant allocated with a greater number of nozzle arrays than other colorants, the nozzle drive control step uses in the first print mode only a particular one of the two or more nozzle arrays allocated to the colorant and, in the second print mode, uses all of the two or more nozzle arrays allocated to the colorant.

With this invention, a printing apparatus can be provided which has a print head with a plurality of resolutions. This reduces a research and development cost in the print head production and a manufacturing line development cost, thus allowing a printing apparatus capable of realizing a high quality printing using a high resolution print head to be introduced into the market in a shorter period of time.

Further, since the printing apparatus of this invention uses a print head with a plurality of resolutions, both a wide tonal range and a high resolution can be realized at low cost.

Further, since this invention permits a desired resolution to be set according to a colorant used, the number of nozzle arrays allocated to a color that makes large contributions to representing grayscale variations may be increased to enhance the resolution of an image. For colors that are not highly visible or distinctive or which are not used frequently for image formation, the print head is set at a low resolution. With this print head, it is possible to minimize the memory area used during a printing operation and still form an image with a visually improved image quality.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Now, embodiments of this invention will be described in detail by referring to the accompanying drawings.

As one embodiment of the invention, an ink jet printing apparatus will be described. Here ink is used as a coloring material and is ejected from printing elements or nozzles onto a print medium. It is noted that this invention is not limited to ink jet printing apparatus but can be applied to any printing apparatus as long as they are constructed of a plurality of printing elements.

Although details will be described later, the ink jet printing apparatus of this embodiment has a monochrome print mode for printing text documents and a color print mode. The color print mode is further divided into a normal print mode giving priority to a print speed and a high resolution print mode giving priority to an image quality. These print modes are chosen according to subject to be printed.

(Construction of Ink Jet Printing Apparatus)

Figure 1:
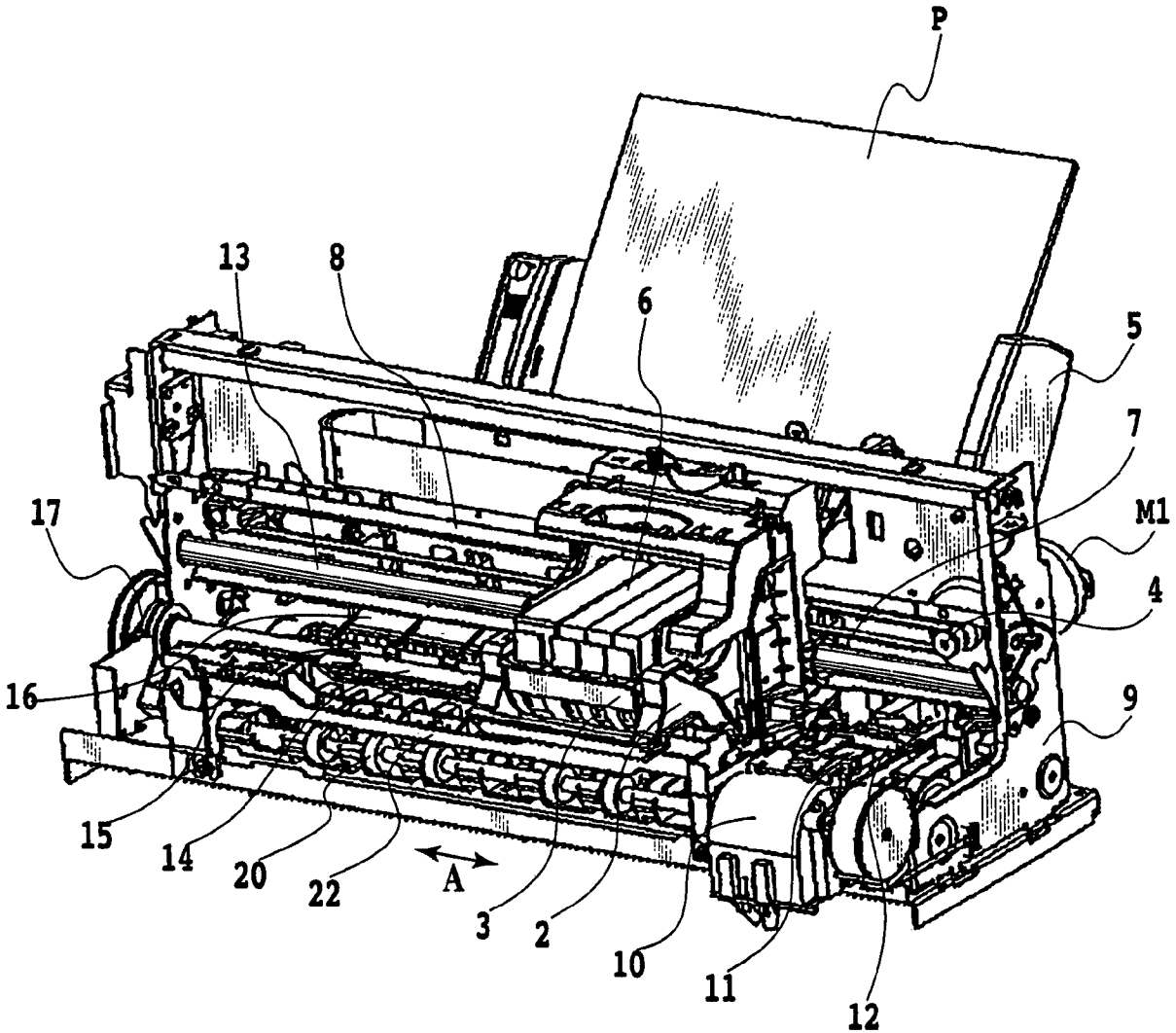
FIG. 1 is a perspective view showing a construction of an ink jet printing apparatus according to one embodiment of this invention.

FIG. 1 is a perspective view showing a construction of an ink jet printing apparatus of this embodiment with a case cover removed.

As shown in the figure, the ink jet printing apparatus of this embodiment has a carriage 2, in which a print head 3 is removably mounted, and a drive mechanism to move the carriage 2 to scan the print head. That is, a drive force of a carriage motor M1 is transmitted through a transmission mechanism 4, such as a belt and pulleys, to the carriage 2 which is then reciprocally moved in a direction of arrow A. The carriage 2 removably mounts ink cartridges 6 corresponding to inks used in the printing apparatus. For simplicity of explanation, only four ink cartridges are shown. In this embodiment, however, it is possible to use five kinds of inks—first and second black ink, cyan, magenta and yellow ink—and thus five separate ink cartridges, one for each kind of ink, may be mounted if necessary. Details of inks will be described later.

The print head 3 is largely divided into a black ink chip and a color ink chip. The carriage 2 is formed with ink supply paths through which supply inks from the cartridges to the corresponding grooves of these chips. The carriage 2 and the print head 3 composed of the above chips are constructed so that their joint surfaces are properly put in contact with each other for electrical connection. The print head 3 thus can apply a pulse voltage to heaters according to a print signal to generate bubbles in nozzles and eject ink droplets by the pressure of the expanding bubbles. The heaters in the form of electrothermal transducers, upon receiving a pulse, generate a thermal energy and cause a film boiling in ink, which in turn ejects ink droplets from the nozzles by the pressure changes as the bubbles expand and contract.

The printing apparatus also has a paper feed mechanism 5 to feed print paper P or print medium a predetermined distance as the print head scan proceeds. At one end of the reciprocal range of the carriage 2 is installed a recovery device 10 to recover an ejection performance of the print head 3.

In the ink jet printer of the above construction, the print paper P is fed by the paper feed mechanism 5 to a scan area of the print head 3 where the print paper is printed with images and characters by the print head 3 being scanned.

The construction of the above printer is explained in more detail. The carriage 2 is connected to a part of a drive belt 7, which makes up the transmission mechanism 4 to transmit the drive force of the carriage motor M1. The carriage 2 is slidably supported and guided along a guide shaft 13 in a direction of arrow A. Thus, the drive force of the carriage motor M1 is transmitted to the carriage 2 for its reciprocal motion. At this time, the carriage 2 can be moved forward or backward by the forward or backward rotation of the carriage motor M1. In FIG. 1, denoted 8 is a scale for detecting a position of the carriage 2 in the direction of arrow A. The scale of this embodiment is black bars printed on a transparent PET film at a predetermined pitch, with one end of the scale secured to a chassis 9 and the other supported by a leaf spring not shown. Thus, the position of the carriage 2 can be determined by a sensor provided on the carriage 2 optically detecting bars of this scale.

In the scan area of the print head 3 there is provided a platen, not shown, that faces the nozzle arrays as the print head 3 scans. By ejecting inks onto the print paper P being fed over the platen, the print paper kept planar on the platen is printed with ink.

Designated 14 is a feed roller that is driven by a feed motor M2 not shown. Designated 15 are pinch rollers that press the print sheet against the feed roller by a spring not shown. Reference number 16 represents a pinch roller holder that rotatably supports the pinch rollers 15. A feed roller gear 17 attached to one end of the feed roller 14 receives the drive force of the feed motor M2 through an intermediate gear not shown and thereby rotates the feed roller 14. A discharge roller 20 discharges the print paper formed with an image by the print head 3 out of the printing apparatus. The discharge roller is driven by the rotation of the feed motor M2. Spur rollers not shown are urged against the discharge roller 20 by a spring not shown to hold the print paper between the discharge roller 20 and the spur rollers. Designated 22 is a spur holder that rotatably supports the spur rollers.

Outside a range where the carriage 2 is moved reciprocally for a printing operation (scan area), the recovery device 10 for maintaining the ejection performance of the print head 3 is arranged at a predetermined position (e.g., a position corresponding to a home position). The recovery device 10 has a capping mechanism 11 for capping a nozzle face of the print head 3 (a surface formed with nozzle arrays for different colors) and a wiping mechanism 12 for cleaning the nozzle face of the print head 3. In synchronism with the nozzle face capping action by the capping mechanism 11, a suction mechanism (e.g., suction pump) in the recovery device not shown is activated. The suction mechanism forcibly sucks out ink from the nozzles to perform an ejection recovery operation by removing viscous ink and bubbles from the ink paths in the print head 3. When a printing operation is not performed, the capping mechanism 11 caps the nozzle face of the print head 3 to protect the print head and prevents ink from drying. Further, the wiping mechanism 12 is arranged close to the capping mechanism 11. The wiping mechanism 12 cleans the nozzle face of the print head 3 by wiping off ink droplets adhering to the nozzle face. With these capping mechanism 11 and wiping mechanism 12, it is possible to keep the print head 3 in a normal ejection state.

Figure 2:
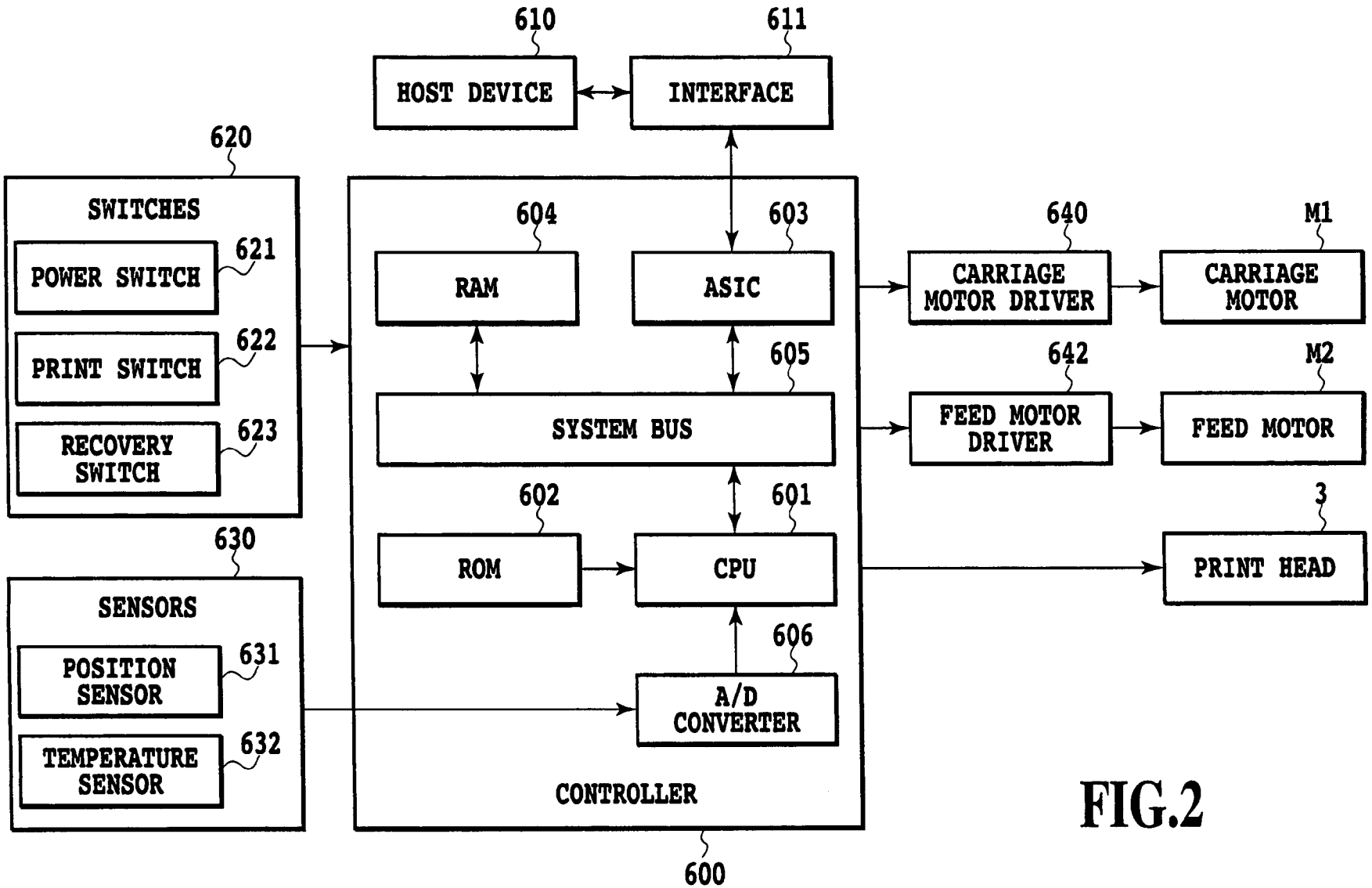
FIG. 2 is a block diagram showing an outline configuration of a control system for the ink jet printing apparatus of FIG. 1.

FIG. 2 is a block diagram showing an outline configuration of the control system for the ink jet printing apparatus constructed as shown in FIG. 1.

As shown in FIG. 2, a controller 600 comprises a CPU 601 in the form of a microcomputer; a ROM 602 storing programs, tables and other fixed data used for executing various print modes described later and controlling the associated printing operations and for performing sequences of image processing described later; an application specific integrated circuit (ASIC) 603 for controlling the carriage motor M1 and feed motor M2 when executing the individual print modes and for generating control signals to control the ejection of the print head 3; a RAM 604 providing an image data mapping area and a work area; a system bus 605 for interconnecting the CPU 601, ASIC 603 and RAM 604 for data transfer; and an A/D converter 606 for inputting analog signals from sensors described in the following, A/D-converting these signals and supplying the converted digital signals to the CPU 601.

Designated 610 is a host computer that functions as an image data source (or image reader or digital camera) and which transfers image data, commands and status signals to and from the controller 600 through an interface (I/F) 611.

Designated 620 is a group of switches, including a power switch 621, a print start switch 622, and a recovery switch 623 for print head 3, all intended to receive instructions from an operator. Denoted 630 is a group of sensors, including a photocoupler 631 used in combination with the scale 8 to detect when the print head 3 is at the home position h, and a temperature sensor 632 installed at an appropriate location in the printer to detect an ambient temperature. A driver 640 drives the carriage motor M1 and a driver 642 drives the feed motor M2.

In the above construction, the printing apparatus of this embodiment analyzes a command of print data transferred through the interface 611 and then maps image data to be printed in the RAM 602. An image data mapping area (expansion buffer) has a lateral size corresponding to the number of pixels Hp in a printable area in the main scan direction and a longitudinal size corresponding to 64n (n is an integer equal to or larger than 1; e.g., n=4) or the number of pixels in the longitudinal direction printed by the nozzle array of the print head in one scan. This area is secured on a memory area in the RAM 602. A memory area on the RAM 602 that is referenced to send data to the print head during the printing scan (print buffer) has a lateral size corresponding to the number of pixels Vp in a printable area in the main scan direction and a longitudinal size corresponding to 64n or the number of pixels in the longitudinal direction printed by the print head in one printing scan. This area is secured on a memory area in the RAM 602.

During the printing scan by the print head, the ASIC 603 directly accesses the memory area in the RAM 602 (print buffer) to retrieve heater drive data for each nozzle of the print head and transfers the heater drive data to the driver of the print head.

Inks used in the ink jet printing apparatus of the above construction will be described in detail.

(Ink)

In this embodiment two kinds of black inks are used for the print modes described above. Of the two inks, a first black ink used in the monochrome print mode for text documents uses a pigment of carbon black as the coloring material. The surface of this pigment is surface-treated with carboxyl group so that it can be dispersed in ink. To minimize water evaporation from ink, it is preferable to add polyol such as glycerin as a humidity retention agent. Further, a pigment of the pigment ink fixes on the print medium surface, so if the pigment ink is used to print characters, deep black and sharp characters can be printed. Since text documents are often printed on plain paper, it is also important that edges of black ink dots not be degraded also on plain paper. To adjust the penetration of the ink, acetylene glycol-based surfactant may be added to a degree that does not degrade edges. It is also possible to add polymer fro higher binding as a binding agent.

The second black ink used in the color print mode uses a black dye as a coloring material. To achieve a quick ink penetration in the surface of the print medium, acetylene glycol-based surfactant is added to more than a critical micelle concentration. Also to minimize water evaporation, polyol such as glycerin is preferably added as a moisture retention agent. It is also possible to add urea for higher solubility of the coloring material.

In color-printing a photographic image, this embodiment uses cyan ink, magenta ink and yellow ink as color inks. These are dye inks. If a pigment ink is used as the first black ink, there is a difference in the ink penetration speed between the color inks and the black ink, making bleeding and feathering more likely to occur at boundary portions between the color inks and the black ink. Thus, when a color printing with a relatively high quality is to be performed, as when printing a photographic image, the black dye ink described above shall be used. For the color inks, therefore, it is preferable to use the similar moisture retention agent, surfactant and additives to those used for the second black ink. It is noted that this invention is not limited to these and the pigment ink and the dye ink may be used in combination.

The surfactant is preferably adjusted so that the second black ink, cyan ink, magenta ink and yellow ink have almost equal surface tensions. By making the penetration abilities in plain paper almost equal as described above, it is possible to prevent bleeding between areas on the print medium printed with different inks. Characteristics other than the above, such as ink penetration and viscosity, are adjusted equally among the second black ink, cyan ink, magenta ink and yellow ink.

(Print Head Construction)

Next, the construction of the print head used in this embodiment will be explained by referring to FIG. 3.

In each print head a plurality of nozzles are arrayed in the print medium feed direction. Each of the nozzles is connected with an ink path and a common ink chamber communicating to an ink tank. In the ink path of each nozzle, a heater or electrothermal transducer is provided. For ink ejection, this heater is energized to generate a bubble in ink and eject by the pressure of the expanding bubble a predetermined volume of ink in the form of an ink droplet onto the print medium. In the following description, the nozzle and its associated ink path are generally called a nozzle.

Figure 3:
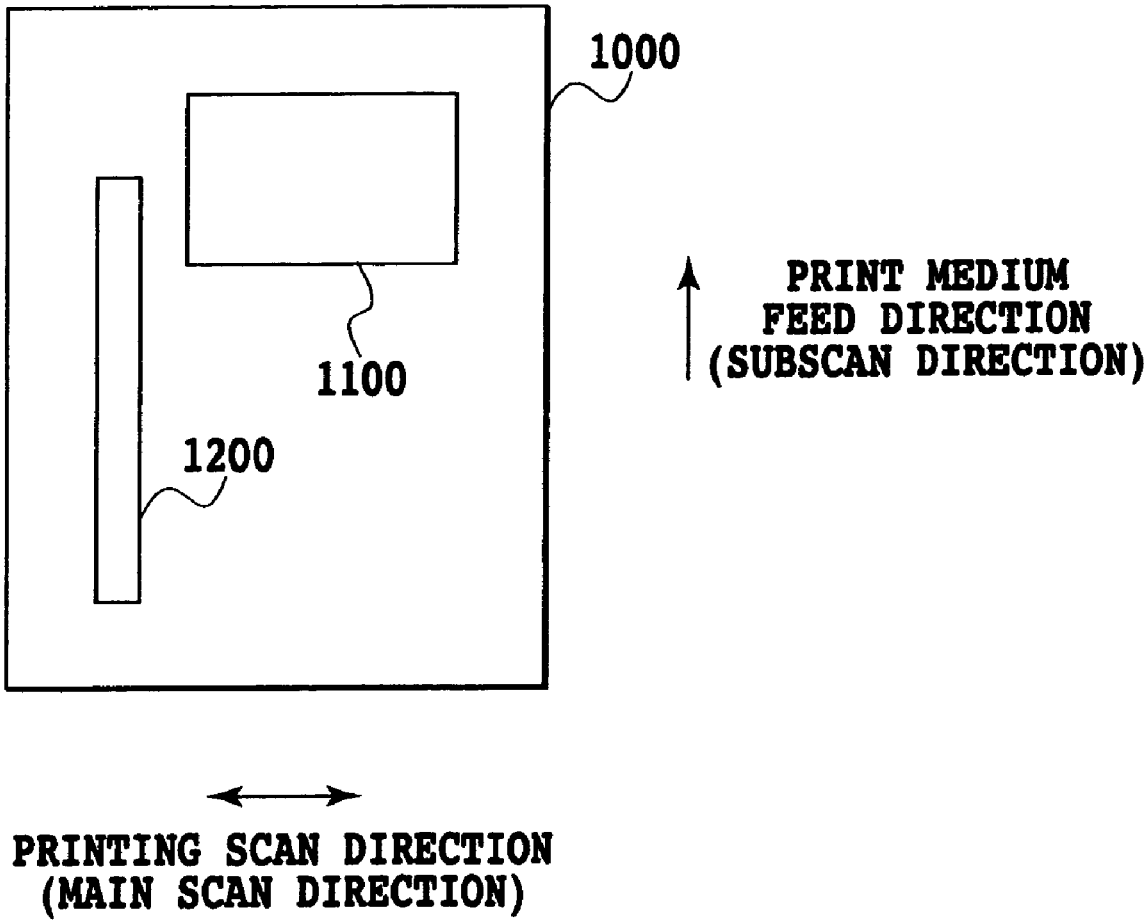
FIG. 3 is a schematic diagram showing a chip configuration in a print head used in one embodiment of this invention.

FIG. 3 schematically shows print chips of the print head mounted in the ink jet printing apparatus as seen from the print medium side.

As shown in the figure, the print head of this embodiment is formed by connecting a color ink chip 1100 and a black ink chip 1200 to a substrate. As can be seen by comparing the color ink chip 1100 and the black ink chip 1200, the black ink chip 1200 is longer in the print medium feed direction. The black ink chip 1200 has nozzles for ejecting the first black ink and is longer in the nozzle array range in the print medium feed direction (subscan direction) than the color ink chip 1100. When a document such as text is printed with only black ink by using the black ink chip, because the print range of the black ink chip in one scan is long, the number of scans required to print one page decreases, thus shortening the time required for printing. In the print mode intended for fast print speed, the black ink chip is very useful, as when printing a text document.

The color ink chip 1100 and the black ink chip 1200 are arranged in positions shifted in the print medium feed direction so that the pigment black ink can be printed first before the application of color inks to the same area on the print medium.

Next, the color ink chip will be explained. To clarify the features of this invention, the conventional nozzle array arrangement and the printing method using this arrangement are also explained as a reference configuration.

(Reference Configuration)

Figure 4:
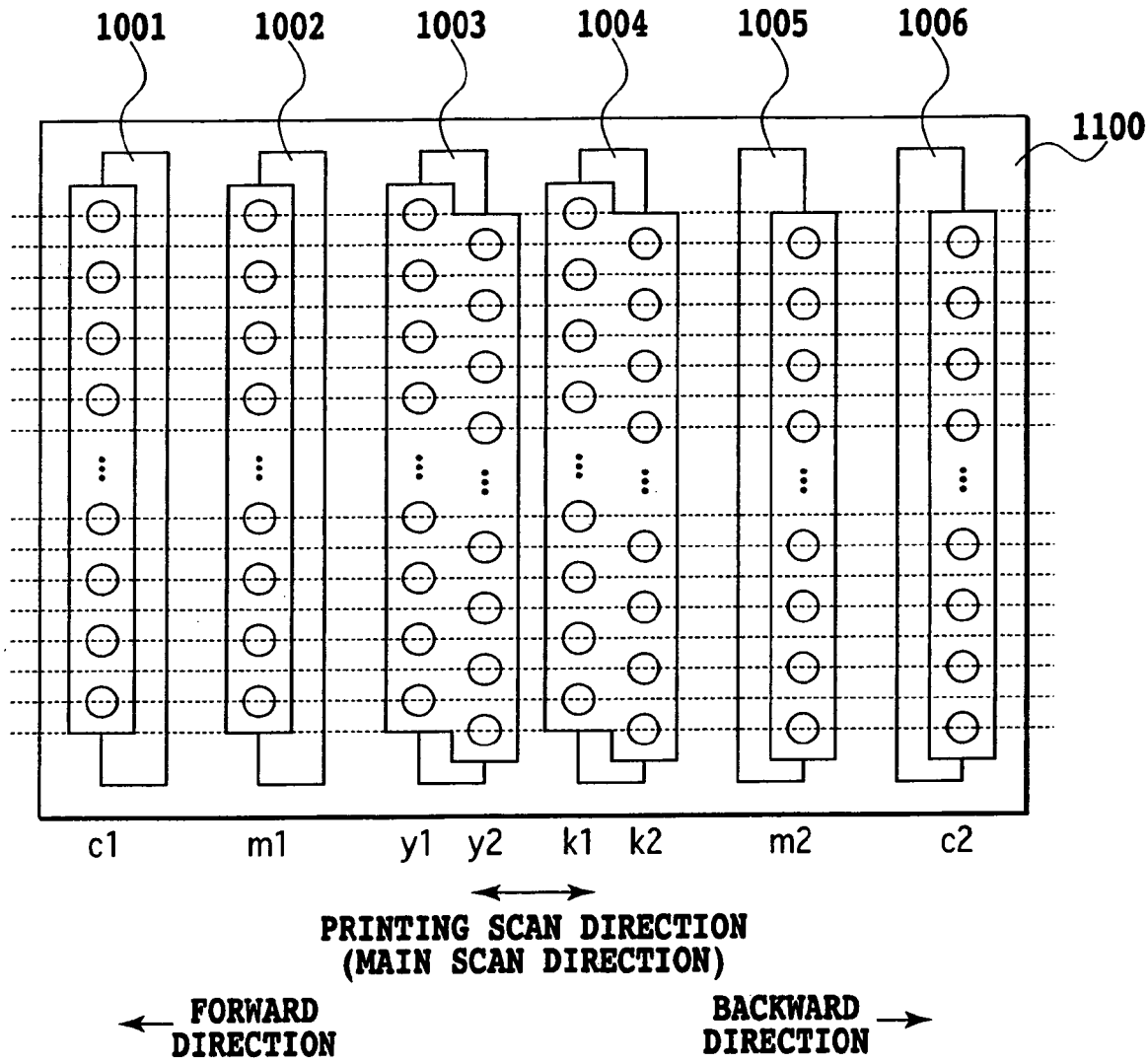
FIG. 4 is a schematic diagram showing an arrangement of nozzle arrays in a color ink chip of a print head used in a reference configuration of this invention.

FIG. 4 schematically shows an arrangement of nozzles of different color inks in the color ink chip 1100.

The color ink chip of this example has a plurality of nozzles for each of cyan, magenta and yellow inks and for the second black ink and also heaters, one for each nozzle, to generate thermal energy to eject ink from the nozzles. The color ink chip 1100 of this reference configuration has two nozzle arrays for each color ink. The two nozzle arrays of each color ink—cyan, magenta and yellow—are arranged symmetrical. As for the second black ink, the nozzle arrays k1, k2 are arranged between the yellow ink nozzle array y2 and the magenta ink nozzle array m2. Therefore, the second black ink nozzle arrays k1, k2 are sandwiched between nozzle arrays of different color inks (in this case, yellow and magenta inks). From the arrangement of FIG. 4, it can be said that the yellow and black ink nozzle arrays are arranged side by side between the symmetrically arranged cyan and magenta nozzle arrays.

In more detail, a silicon chip 1100 of the color ink chip is formed with six grooves and, for each groove, with the above-described nozzles for color inks. That is, nozzles, ink paths communicated with the nozzles, heaters formed in one part of each ink path, and a supply path common to the ink paths are formed in the one chip.

Between the grooves in the chip 1100 drive circuits for energizing the heaters (not shown) are provided. The heaters and drive circuits are fabricated by the same process as a semiconductor deposition process. The ink path and nozzles are formed of resin. Further, at the back of the silicon chip an ink supply path for supplying inks to the associated grooves are formed.

The six grooves are called, from left to right in the scan direction in the figure, a first groove 1001, a second groove 1002, a third groove 1003, a fourth groove 1004, a fifth groove 1005 and a sixth groove 1006. In this embodiment, the first groove 1001 and the sixth groove 1006 are supplied with cyan ink; the second groove 1002 and the fifth groove 1005 are supplied with magenta ink; the third groove 1003 is supplied with yellow ink; and the fourth groove 1004 is supplied with second black ink composed of a dye as a coloring material.

The first groove 1001 is formed with a cyan ink nozzle array c1 made up of 64n nozzles (n is an integer equal to or larger than 1; for example, n=4) and the second groove 1002 is formed with a magenta ink nozzle array m1 made up of 64n nozzles. The third groove 1003 on the second groove side is formed with a yellow ink nozzle array y1 made up of 64n nozzles and, on the fourth groove side, is formed with a yellow ink nozzle array y2 made up of 64n nozzles. Further, the fifth groove 1005 is formed with a magenta ink nozzle array m2 made up of 64n nozzles, and the sixth groove 1006 is formed with a cyan ink nozzle array c2 made up of 64 n nozzles. The fourth groove 1004 on the third groove side is formed with a dye black ink (second black ink) nozzle array k1 made up of 64 n nozzles and, on the fifth groove side and adjacent to the nozzle array k1, is formed with a nozzle array k2 for the same dye black ink as the nozzle array k1, made up of 64n nozzles.

These nozzle arrays have their nozzles arrayed at almost equal pitches. The nozzle arrays of the same color ink are staggered by one-half of the nozzle pitch in the subscan direction. This arrangement is made to ensure that a dot coverage in each pixel in one printing scan is highest.

For the color printing, this embodiment uses cyan, magenta and yellow inks as a first combination of inks. As a second ink combination, the second black ink is combined with each of cyan, magenta and yellow inks. As can be seen from the symmetrical arrangement in FIG. 4, the first ink combination can have two different orders of ink application in the case of secondary or tertiary colors that are created by using arbitrary two kinds of inks.

As described above, the cyan and magenta inks are arranged line-symmetrical about the center line of the chip in the printing scan direction. When the inks are applied to the print medium in the order of array arrangement, beginning with the ink array situated at the front of the chip in the scan direction, secondary color dots show subtle changes in hue according to a difference in the ink overlapping order. The relation between this phenomenon and the order of array arrangement will be explained in more detail with reference to the drawing.

Figure 5:
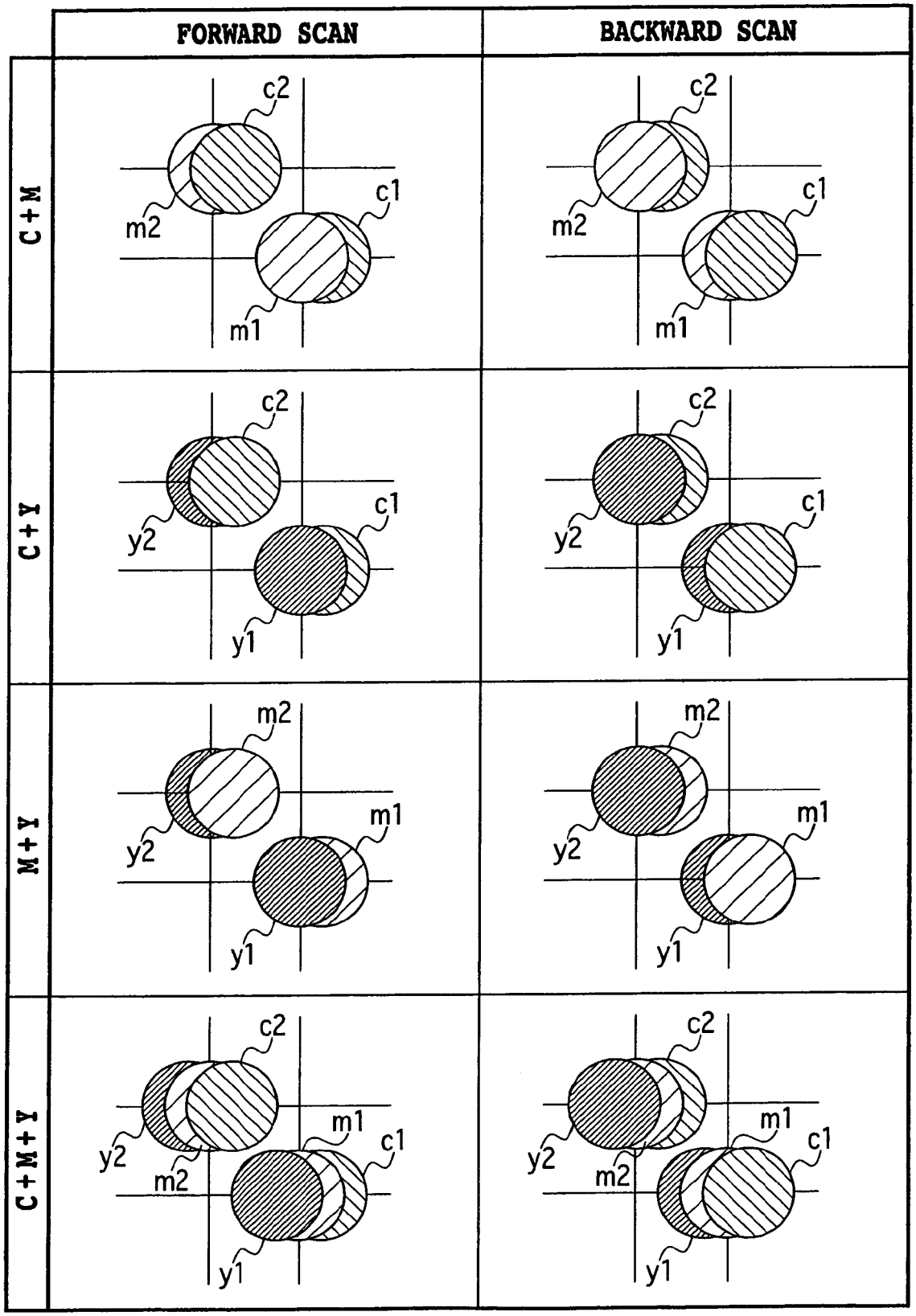
FIG. 5 is a schematic diagram showing a relation between combinations of a plurality of inks, an ink application order and a print head scan direction.

In FIG. 5, a cyan dot (a dot printed with a cyan ink) is represented by vertical lines, a magenta dot by horizontal lines and a yellow dot by grid lines. To make the actual order of dot overlapping easily understandable, the dots are schematically shown deviated from their intended positions.

Suppose that a secondary color (blue) is created by the adjoining cyan array and magenta array. As can be seen from the figure, a secondary blue color (C+M), created by a combination of cyan ink and magenta ink, is represented by dots that are formed by a nozzle array combination of c1 and m1 and a nozzle array combination of c2 and m2 in the forward and backward scans. From the diagram it is seen that the dots formed by the combination of c1 and m1 and the dots formed by the combination of c2 and m2 have opposite ink application orders in both the forward and backward scan. That is, in both the forward and backward scan, two kinds of pixels can be formed, one of which has a cyan dot printed first, followed by a magenta dot, and the other has a magenta dot printed first, followed by a cyan dot.

The two kinds of pixels or dot combinations with different dot overlapping orders can be made to occur in nearly equal numbers in each of the forward and backward scans by processing print data. This arrangement is possible with either a 1-pass printing or a multipass printing described later. In a bidirectional printing, rather than controlling to form dots in the same dot application order for all pixels, this embodiment as described above provides two kinds of dot application order or dot overlapping order and processes print data so that these two different dot combinations occur in almost equal numbers. In other words, two kinds of dot combinations with different dot application orders are scattered in a predetermined direction. This makes color variations caused by differing ink application orders less distinctive.

Similarly, when a secondary green (C+Y) is created by a combination of cyan and yellow, a combination of nozzle arrays c1 and y1 and a combination of nozzle arrays c2 and y2 are used. As a result, in both of the forward and backward scans, two kinds of pixels can be formed, one of which has a cyan dot printed first, followed by a yellow dot, and the other has a yellow dot printed first, followed by a cyan dot. When a secondary red (M+Y) is created by a combination of magenta and yellow, a nozzle array combination of m1 and y1 and a nozzle array combination of m2 and y2 are used. In both of the forward and backward scans, two kinds of pixels can be formed, one having a magenta dot printed first, followed by a yellow dot and one having a yellow dot, followed by a magenta dot. Also for tertiary colors created by cyan, magenta and yellow inks, the use of a nozzle array combination of c1, m1 and y1 and a nozzle array combination of c2, m2 and y2 can form two kinds of pixels, one having a cyan dot, a magenta dot and a yellow dot applied in that order and one having a yellow dot, a magenta dot and cyan dot applied in that order.

In this embodiment too, the color variation prevention effect can be produced by the above method of printing two kinds of dot combinations with different ink application orders in both the forward and backward print head scan directions.

For the second black ink, two kinds of dot overlapping similar to those described above can also be used. It is noted, however, that since the nozzle array arrangement is not symmetrical, the two dot overlapping orders shown in FIG. 5 are not completely opposite to each other.

Details of nozzle array arrangement in the color chip of the print head of this embodiment will be described later. Here, data processing to create actual ejection data from image data transferred from a host computer is described in detailed by assuming that four ink colors, cyan, magenta, yellow and black (second black ink in the case of color printing), are used.

(Data Processing)

In this embodiment, predetermined image processing is performed on multivalue data of red (R), green (G) and blue (B) to transform them into quantized multivalue data of cyan, magenta, yellow and black. For simplicity, a conversion to 2-value data or 3-value data is explained here. Although this processing is performed in a host device 610 in this embodiment, it may be done by a controller of the printing apparatus.

Generally, data processing is executed according to the print mode. For example, in a print mode intended for a fast print speed, data is converted into 2-value data of 0 and 1; and in a high quality print mode that gives priority to quality over speed, data is converted into 3-value data of 0, 1 and 2.

In this data processing and printing operation, a pixel is a unit or size of area covered by dots formed by two adjoining nozzles of two nozzle arrays of the same ink color, shown in FIG. 4, which are spaced from each other in the subscan direction by one-half of the nozzle pitch in each nozzle array. In this pixel, these dots are formed in separate positions. That is, the pixel is an area having two dots formed on two lattice points as shown in FIG. 5.

While this invention defines a pixel as described above, it is possible to deal with different types of pixels depending on an input resolution. That is, for data having two times the resolution of the above example, one pixel is defined by one dot formed by one nozzle. For data having one-half the resolution of the above example, a plurality of dots printed by four nozzles arranged in the subscan direction can be taken as one pixel.

Data processing in a bidirectional printing follows. The data processing distributes data to two nozzle arrays of each color ink formed in the print head. More specifically, a print buffer is provided for each nozzle array and the 2- or 3-value data is stored in the corresponding print buffer. In each print scan, data is read out from the print buffer corresponding to each nozzle array and transferred to the associated nozzle arrays for ejecting ink from nozzles.

Data processing for each mode will be explained in more detail.

(Processing 2-Value Data)

When the quantized data of cyan, magenta and yellow are 2-value data, the same print buffer is used for a pair of two nozzle arrays of the same ink color.

More specifically, the cyan nozzle array c1 and cyan nozzle array c2 in FIG. 4 are assigned the same cyan first print buffer. Similarly, the magenta nozzle array m1 and magenta nozzle array m2 are assigned a magenta first print buffer; and the yellow nozzle array y1 and yellow nozzle array y2 are assigned a yellow first print buffer.

In other words, the 2-value data of, say, cyan ink are mapped or rasterized all in the cyan first print buffer. Then, in a forward scan the 2-value data mapped in the cyan first print buffer is referenced and transferred to the corresponding nozzles of the cyan nozzle array c1 and cyan nozzle array c2 for ink ejection. That is, when the data value is 1 (ejection), ink is ejected from the corresponding nozzles of both the cyan nozzle arrays c1 and c2. In a backward scan also, 2-value data mapped in the cyan first print buffer is referenced and transferred to the corresponding nozzles of the cyan nozzle array c1 and cyan nozzle array c2 for ink ejection.

As described above, two dots are ejected from the cyan nozzle array c1 and cyan nozzle array c2 onto the same pixel. That is, when the pixel has 2-value data of 1, it is applied with two dots ejected from nozzles of two different nozzle arrays of the same ink color. Similarly, for magenta and yellow inks, too, reference is made to the magenta first print buffer and the yellow first print buffer respectively and the corresponding two nozzle arrays of each color are activated to print an image.

Since two dots making up each pixel (with 2-value data of 1) are applied from different nozzle arrays, there are two kinds of ink application orders also for secondary and tertiary colors and, in a printed image as a whole, two kinds of pixels or dot combinations with different dot application orders as shown in FIG. 5 exist in equal numbers. As a result, the difference in the ink application order or overlapping order for each color ink caused by the opposite scan directions can be alleviated both in units of pixel and in the overall printed image, thus minimizing color variations.

Depending on a print mode, the first black ink or pigment ink is used and its 2-value data is stored in one print buffer as in the normal printing. In a printing operation, data stored in the print buffer is referenced and matched to the corresponding nozzles of the black ink chip 1200 before being transferred to the print head. This also applies similarly to the 3-value data described below.

(3-Value Data)

When quantized data of cyan, magenta and yellow are 3-value data, a pixel of each color is represented by three combinations of dots—no dot applied, one dot applied and two dots applied. The content of 3-value data is either 0, 1 or 2. 0 represents no dot, 1 represents one dot, and 2 represents two dots.

The print buffer manages its memory area by dividing it into a first print buffer and a second print buffer to match the corresponding nozzle arrays of each ink color. That is, the cyan nozzle array c1 is assigned a cyan first print buffer, the magenta nozzle array m1 is assigned a magenta first print buffer, and the yellow nozzle array y1 is assigned a yellow first print buffer. Further, the yellow nozzle array y2 is assigned a yellow second print buffer, the magenta nozzle array m2 is assigned a magenta second print buffer, and the cyan nozzle array c2 is assigned a cyan second print buffer.

When the quantized 3-value data is 0, a binary 0 representing no data is mapped in both the first and second print buffer. When the quantized 3-value data is 2, a binary 1 representing 1-dot data is mapped in both the first and second print buffers. Thus, when the 3-value data of an ink color is 2, two dots, one from each of the two different nozzle arrays, are formed in those pixels having 3-value data of 2 in both the forward and backward scans. When the quantized 3-value data is 1, a binary 1 is mapped in only one of the first and second print buffers with 0 assigned to the other. Each time the 3-value data is 1 for each ink color, which of the print buffers the binary 1 is mapped in is memorized. The data mapping is controlled in such a way that if the 3-value data is 1 the next time, the print buffer to map the data is switched to the other. As described above, for those pixels with 3-value data of 1, one dot is formed by one of the two different nozzle arrays.

As a result of allocating the 3-value data as described above, when a large number of pixels are viewed macroscopically, there are equal numbers of dots that are printed by different nozzle arrays. This means that, probabilistically, two kinds of dot combinations with different ink application orders exit in equal numbers. This makes color variations visually less distinctive.

As described above, when the quantized data is a 2-value data, the volume of data to be processed is smaller than that of 3-value data and thus the 2-value data processing is suited for a high-speed print mode. In the case of 2-value data processing, however, since each pixel in this embodiment is made up of two dots, a printed image appears degraded in terms of graininess when compared with one printed by the 3-value processing that uses one dot in a low-density area of the printed image. Therefore, in a high quality print mode 3-value data is used. It is also possible to perform a 2-value quantization for yellow which exhibits less quality degradation in terms of granular impression and, for other colors, use a 3-value quantization.

This embodiment also performs 4-value or even higher-value grayscale representation, which is described later. In these higher-value data processing also, the nozzle arrays are assigned print buffers in the same way as in the 3-value data allocation. Further, as in the 3-value data, when a pixel is represented by an even number of dots, data is mapped to print the same number of dots in both the first and second print buffer. When a pixel is represented by an odd number of dots, data mapping is made so that one of the first and second print buffers has one more dot than the other print buffer. Each time the number of dots used for pixel grayscale representation in each ink color is odd, which of the print buffers has mapped the 1-dot-more data is memorized. Then, the data mapping is performed in such a way that if the number of dots applied to a pixel is odd the next time, the print buffer to map the 1-dot-more data is switched to the other.

As for the black ink (second black ink), although its two nozzle arrays, as shown in FIG. 4, are not symmetrically arranged as the cyan, magenta and yellow ink nozzle arrays are, the allocation of black print buffer and quantized data is performed in the manner similar to that of cyan, magenta and yellow.

More specifically, when the quantized data is 2-value data, one and the same print buffer is shared by the two nozzle arrays. If the quantized data is 3-value data, the memory area is divided into a first print buffer and a second print buffer to match their corresponding nozzle arrays. That is, the black nozzle array k1 is allocated with a first print buffer and the black nozzle array k2 with a second print buffer. The allocation of 3-value data is also performed in the same way as that of cyan, magenta and yellow.

In the printing apparatus of this embodiment, the number of scans required to print a particular area differs according to the print mode. In a monochrome print mode intended for high speed printing, which is suited for text documents, a 1-pass printing is performed; and in a print mode that puts a quality over speed, a multipass printing is performed. Each of these printing methods will be described in more detail. These printing methods use a bidirectional printing.

(1-Pass Printing)

Figure 6:
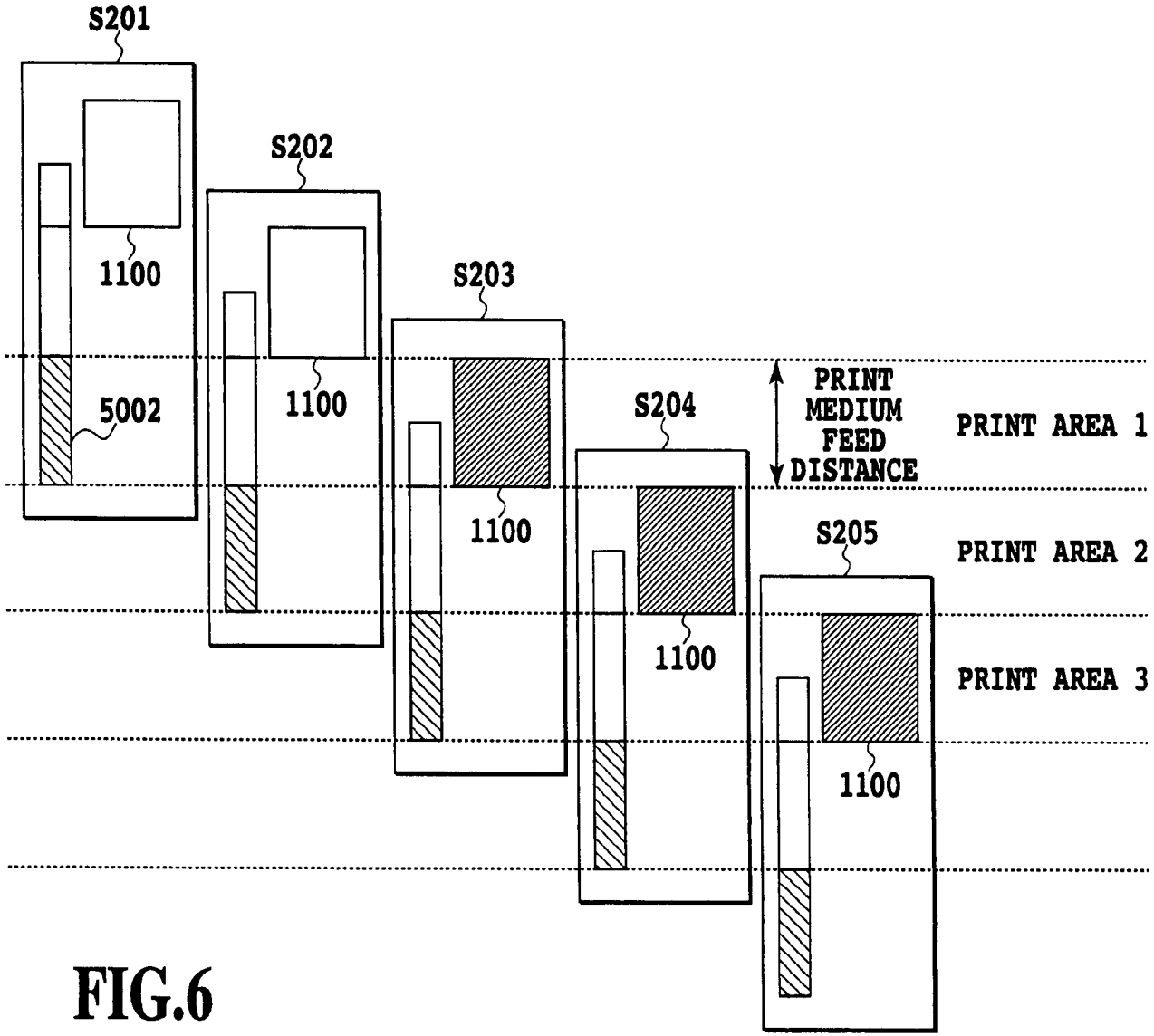
FIG. 6 is a schematic diagram showing a 1-pass printing process.

FIG. 6 schematically shows a 1-pass printing that completes a color printing in one scan.

In FIG. 6, 1100 represents a color ink chip of FIGS. 3 and 1200 represents a pigment black ink chip of FIG. 3. In FIG. 6, these chips are shown to have widths equal to a nozzle array width which is a printable width in a printing scan. Areas shaded with slant lines or a net represent a nozzle portion. Broken lines in the figure indicate a distance that the print medium is fed in a single subscan (paper feed). That is, the paper feed distance in one subscan in this embodiment is equivalent to 64n pixels, a width of nozzle array of each color in the color ink chip of FIG. 4 that is activated in one scan of the print head. In the figure, the lateral direction on the paper is the scan direction of the print head and the upward direction on the drawing represents a downstream side of the print medium feed direction.

The 1-pass printing in this embodiment has two modes, one of which uses both the black ink chip and the color ink chip and the other uses only the color ink chip. In the following the mode using the two chips will be explained. It is noted that the mode using only the color ink chip also performs the similar operation to that described below, and thus its explanation is omitted. In the mode using the both chips, the second black ink nozzle arrays k1, k2 in the color ink chip 1100 are not used.

First, a forward scan S201 prints a print area 1 using the pigment black ink chip 1200.

Next, the print medium is fed a distance equal to 64n pixels and a backward scan S202 prints a print area 2 using the pigment black chip 1200.

Then, the print medium is fed a distance equal to 64n pixels and a forward scan S203 prints a print area 3 using the pigment black chip 1200 and at the same time the color ink chip 1100 prints the print area 1.

In the following backward or forward scans S204, S205, . . . with a 64n-pixel paper feed operation interposed, two print areas are printed by the associated chips, as in the scan S203, to complete an image.

In this printing operation, the printing over the same print area of the pigment black ink can be performed one print scan earlier than the color printing. This allows the pigment black ink to fully penetrate into the print medium before color inks are applied, thus reducing bleeding between black and color inks. Color variations caused by differing orders of color ink application can also be alleviated because printing is performed so that two kinds of dot combinations with different ink application orders are produced in equal numbers.

(Multipass Printing)

This embodiment generates data for each of a plurality of scans required to complete the printing in a particular print area by a multipass printing and controls the printing operation based on the generated data. In the following, a random mask and a control of printing operation based on the data generated by the random mask are explained. The multipass printing, as described later in the print mode explanation, is performed in a mode that uses a pigment black ink or first black ink or a dye black ink or second black ink in addition to cyan, magenta and yellow inks.

(Generating Random Mask)

Figure 7:
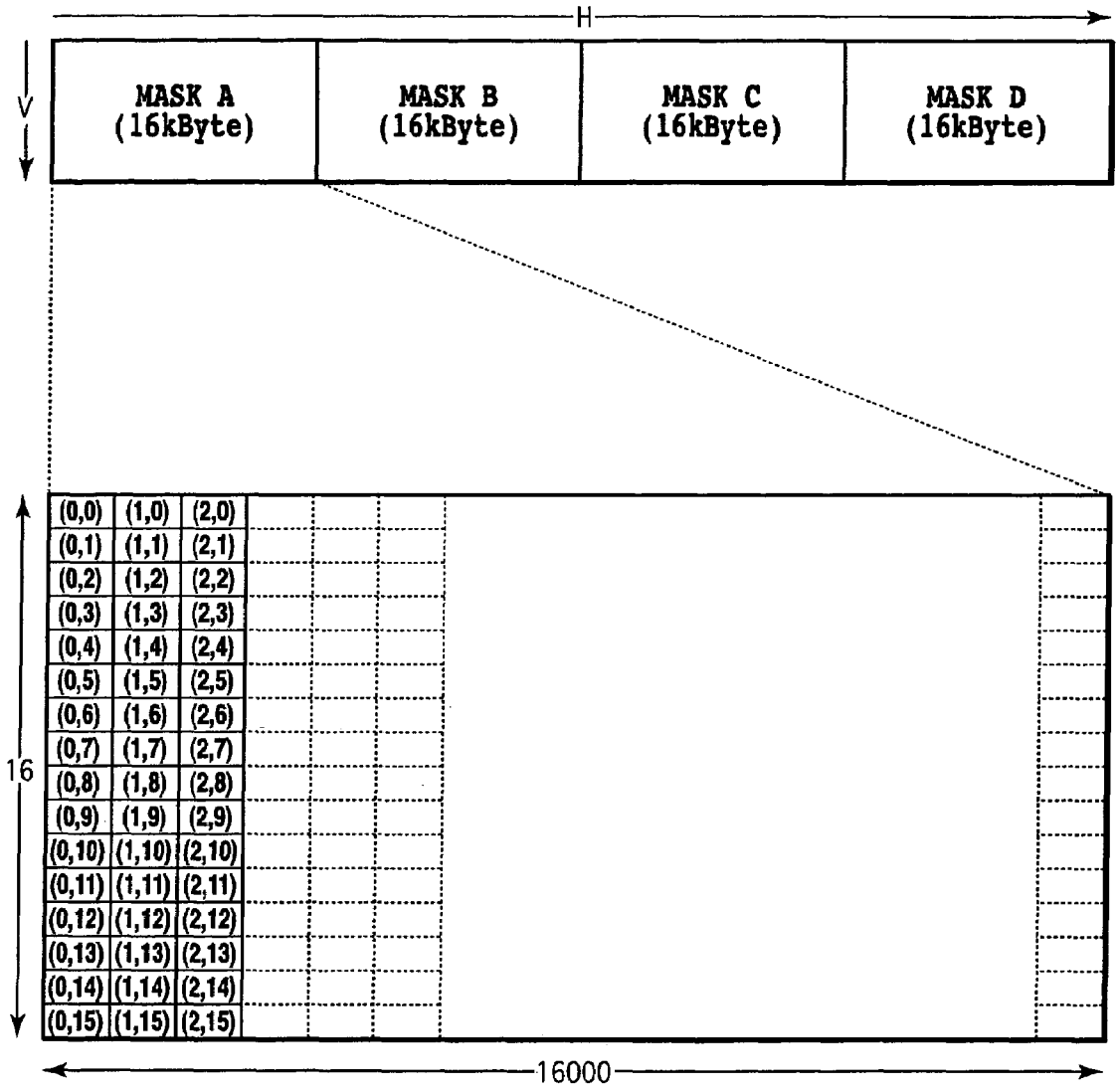
FIG. 7 is a schematic diagram showing a mask used in a multipass printing.

FIG. 7 schematically shows a mask configuration that completes an image in the same print area in four scans.

The mask is made up of four areas, mask A, mask B, mask C and mask D. Each of these masks A, B, C, D has 16 kilobytes (1 kB is 16000 bits). More specifically, each mask is 16 bits long and 16000 bits wide. The relation between the longitudinal and horizontal bits matches that between the longitudinal and lateral sizes of pixels making up quantized image data. As shown by arrows in the figure, the position of a pixel in the mask is controlled by taking the vertical direction as V and the horizontal direction as H. Here, the mask A, mask B, mask C and mask D are provided in one continuous memory area so that they can be managed by the horizontal H dimension. With this method of management, the head of the mask A is (H, V)=(0, 0), the head of the mask B is (H, V)=(16000, 0), the head of the mask C is (H, V)=(16000×2, 0) and the head of the mask D is (H, V)=(16000×3, 0).

Figures 8, 8A:
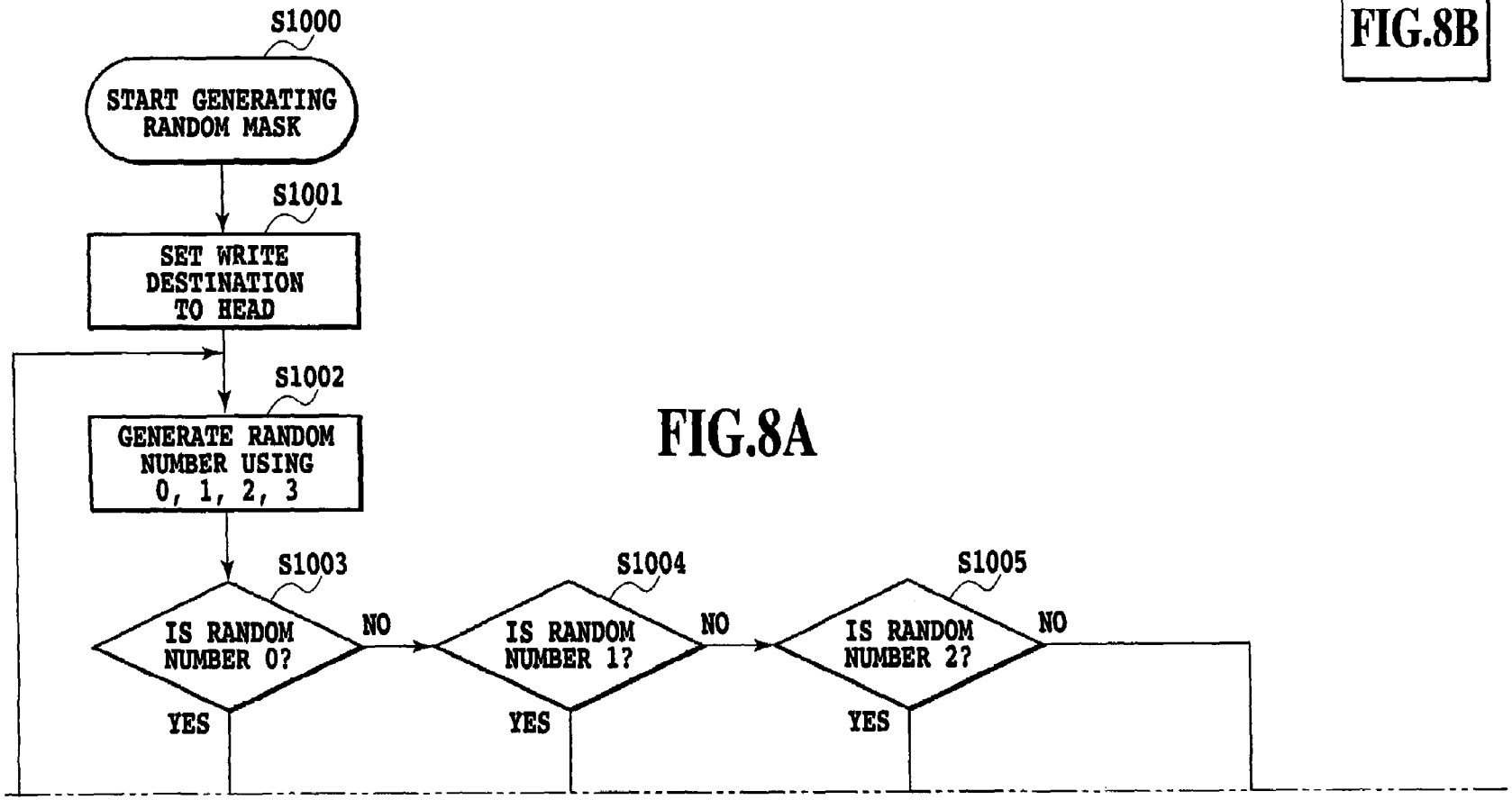
FIG. 8 is a diagram showing a relation between FIG. 8A and FIG. 8B.
FIG. 8A is a part of a control flow chart showing an example random mask generation procedure.
Figure 8B:
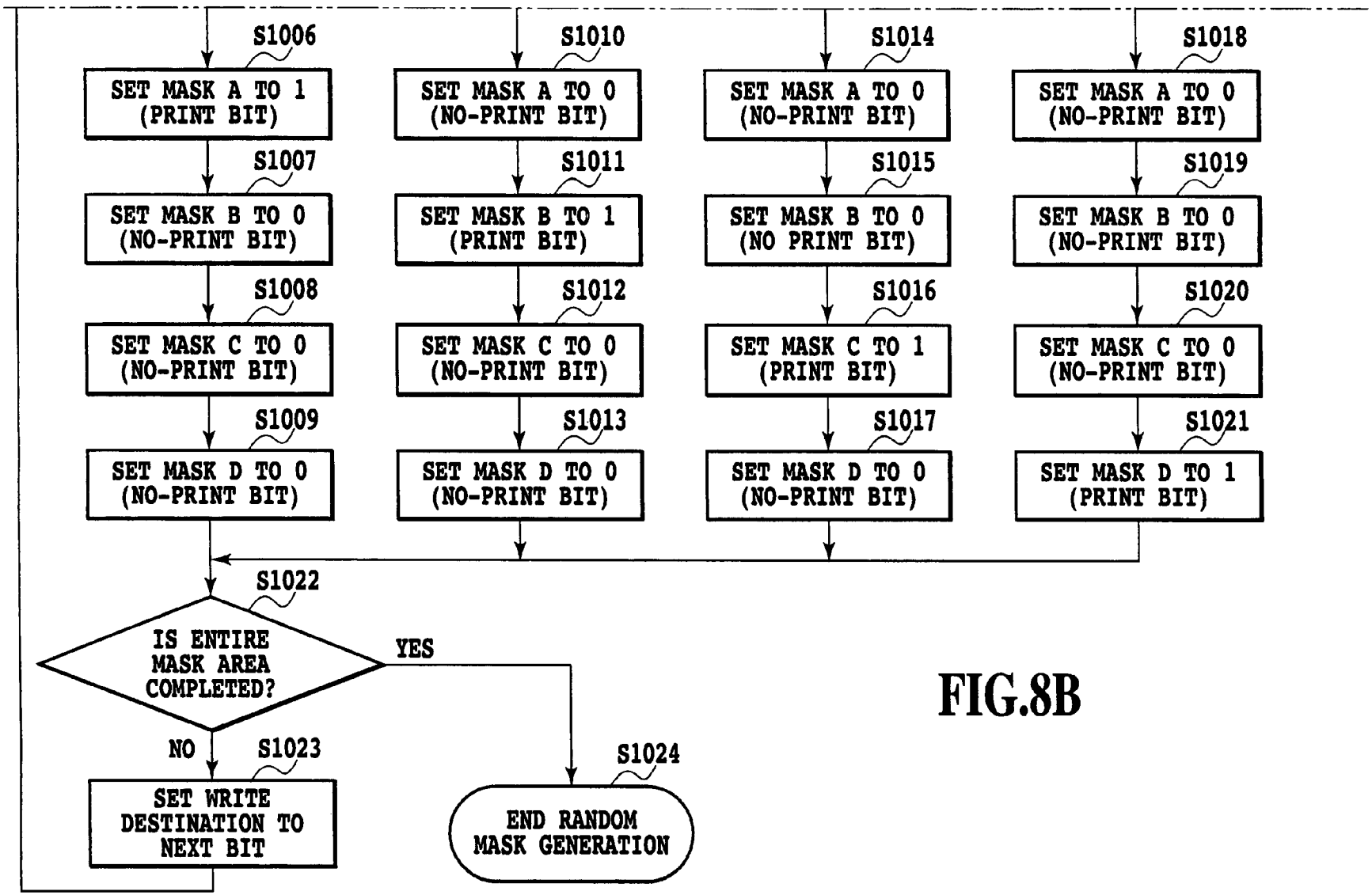
FIG. 8B is another part of a control flow chart showing an example random mask generation procedure.

FIG. 8A and FIG. 8B is a flow chart showing a procedure of generating a random mask of this embodiment.

The generation of a random mask is started in step S1000. Next, in step S1001 the position at which to start the mask setting is set at the head of the mask. That is, for the mask A the mask setting start position is (H, V)=(0, 0); for the mask B, (H, V)=(16000, 0); for the mask C, (H, V)=(16000×2, 0); and for the mask D, (H, V)=(16000×3, 0). Next in step S1002, random numbers consisting of 0, 1, 2 and 3 are generated. Then, in step S1003, S1004 and S1005, a mask is determined that sets a print bit or a no-print bit according to the value of random number.

When the random number is determined to be 0 in step S1003, the procedure executes steps S1006, S1007, S1008 and S1009. That is, S1006 sets 1 in the mask A to form a print bit. Here, the print bit enables the image data corresponding to the pixel of the mask or pixel data. If binary data of that pixel is 1, for example, a dot is formed in the pixel. The no-print bit disables the corresponding pixel data. Next, in step S1007, S1008 and S1009, 0 is set in the mask B, mask C and mask D to form a no-print bit. When the random number is 1, a print bit is set in the mask B and a no-print bit is set in other masks; when the random number is 2, a print bit is set in the mask C and a no-print bit is set in other masks; and when the random number is 3, a print bit is set in the mask D and a no-print bit is set in other masks. After the mask setting is done for each pixel, S1022 checks whether the bit setting is complete for all mask area. This check is a decision as to whether the current setting position of the mask A is (H, V)=(16000, 16). If S1022 decides that the bit setting is not finished for the entire mask area, the procedure moves to step S1023, where it specifies a position on the mask for the next setting. Here the current V coordinate is incremented by one. It is noted, however, that if the current V coordinate is 16, V is set to 1 and the H coordinates of the mask A, mask B, mask C and mask D are incremented by one. After S1023, the procedure proceeds to S1002 where it starts the above processing all over again. If step S1022 decides that the bit setting is finished for the whole mask area, the procedure moves to step S1024 where it ends the random mask generation processing.

(Print Control)

The random mask is so configured that it can be set for a printable area on the print medium. The coordinates of the printable area on the print medium is defined by a main scan direction Hp and a subscan direction Vp. This embodiment performs a multipass printing, by which a particular print area is scanned four times to complete an image on that area.

This printing apparatus analyses a command of print data transferred from a host device 610 through an interface I/F 611 (FIG. 2) and maps it on the RAM as image data to be printed. A mapping area (expansion buffer) for the image data is secured on the RAM, measuring Vp pixels wide in the horizontal direction, equal to a printable area, and 16n pixels long, one fourth of 64n pixels, 64n pixels being the vertical width of an area printed in one scan. A memory area (print buffer), which the print head references during the scan, is also secured on the RAM, measuring Vp pixels wide in the horizontal direction, equal to the printable area, and 64n pixels long which is equal to the longitudinal width printed in one scan.

The ASIC of this printing apparatus is so configured as to be able to specify an H coordinate as a start position of a random mask in the horizontal direction of the print buffer for every longitudinal 16 pixels. Further, the ASIC has another function which, when the end of a random mask in the horizontal direction of the print area is reached, returns to the head of the random mask. That is, the horizontal range of a random mask from H=0 to H=16000 is repetitively allocated horizontally to the print area.

Based on the above configuration, the ASIC during the print head scan matches the image data of the print buffer with the random mask data, directly references the memory area and performs a logical AND operation on both data before transferring the drive data to the print head.

Since in this embodiment an image is completed in four scans, a single print head scan completes the image over one fourth the vertical width of the print head. Thus, after one print head scan, one fourth of the image data mapped in the print buffer on the downstream side of the print medium feed direction becomes unnecessary. Thus, the area of the print buffer that has become unnecessary is used as an expansion buffer for mapping image data, and the memory area that was used as the expansion buffer is now used as the one-fourth of the print buffer. That is, the memory area is managed in units of one fourth the width printed in one scan of the print head. Then, these five areas are used in rotation as the expansion buffer and the print buffer.

Figure 9:
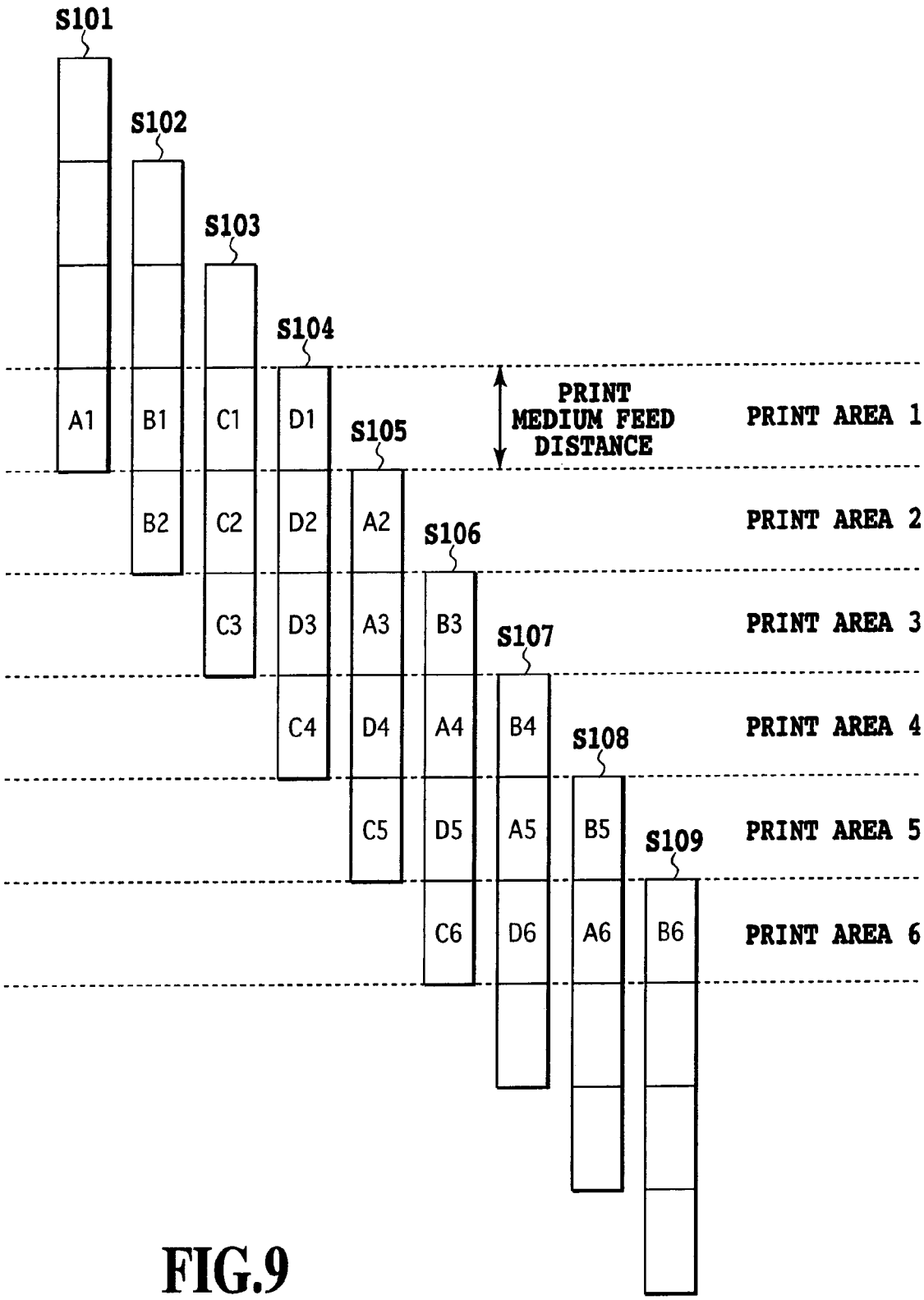
FIG. 9 is a schematic diagram showing a multipass printing process and mask patterns used in the multipass printing.

FIG. 9 schematically shows how the masks are used in each scan during the printing operation of this embodiment.

In the figure, dashed lines indicate a distance the print medium is fed by one subscan operation. The feed distance in one subscan, as described above, is 16n pixels in this embodiment, one fourth the vertical width printed in one scan of the print head. In the figure horizontal direction is the print head scan direction and the upward direction is the downstream side of the print medium feed direction.

In FIG. 9, reference numbers A1, B1, C1, D1, . . . are management numbers representing start points of the random masks A, B, C, D in the print area. By differentiating the start points of the masks in this way, different masks are allocated to different print areas and scans. For the same print area, four masks complement one another. Those management numbers having the same subscript number indicate that the start positions of the random masks are offset horizontally by 16000 pixels.

By using the color chip of FIG. 4 as described above, the order of applying to each pixel two color inks used for creating a secondary color can be changed. That is, since the overlapping order of two dots of ink applied to the same pixel can be changed, it is possible in the case of secondary colors to uniformly scatter in the printed image two kinds of dot combinations with different ink overlapping orders. This in turn minimizes color variations caused by variations in the ink overlapping order. Further, in a print mode intended for high image quality, a multipass printing may be performed to realize a desired printed quality.

However, for an even higher print quality, an additional means such as increasing a resolution is required. Rather than increasing a drive frequency to increase the number of dots that can be applied to a particular area, this embodiment instead increases the number of nozzle arrays in the color chip to adjust the positional relationship between two adjoining nozzle arrays to narrow a pitch of dots applied, thereby enhancing the resolution.

Figure 10:
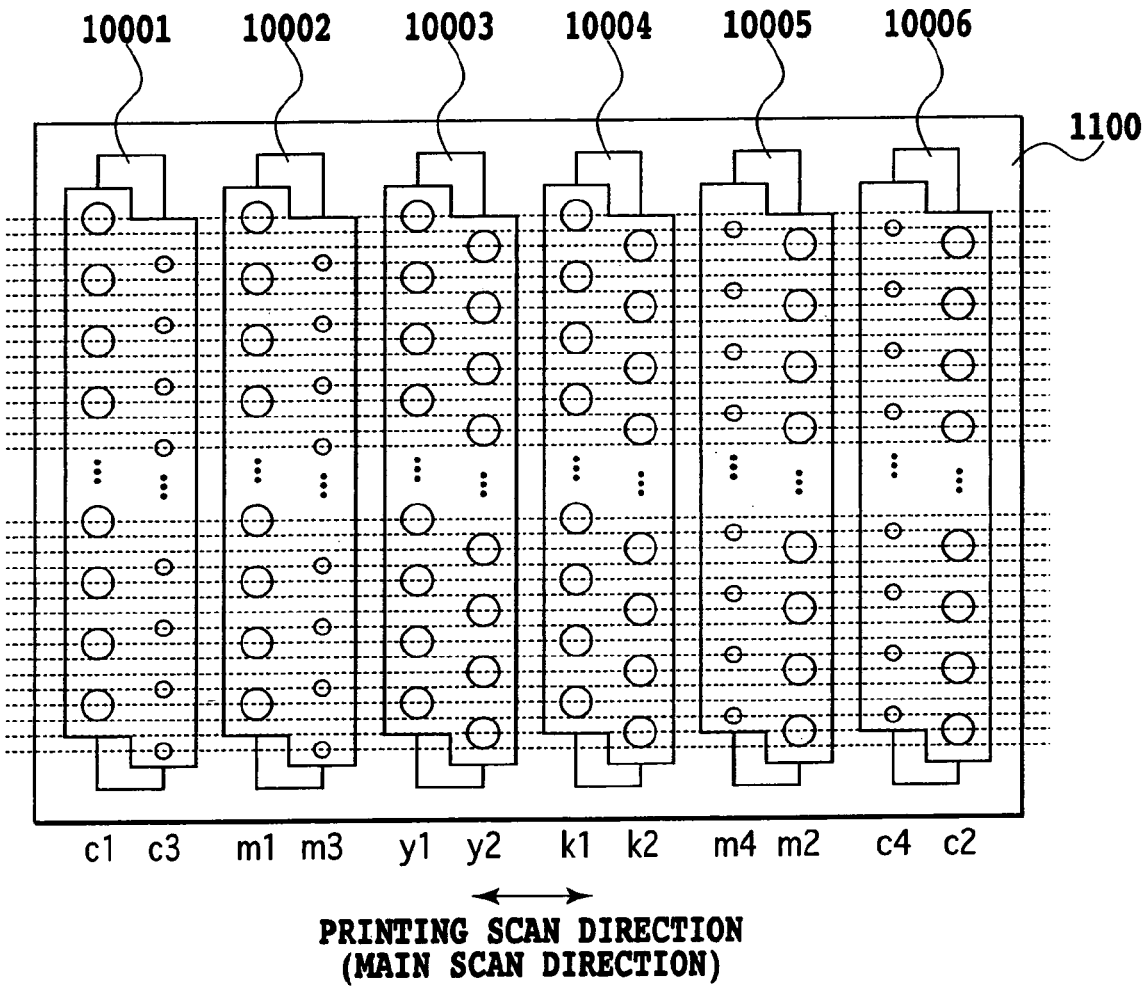
FIG. 10 is a schematic diagram showing an example arrangement of nozzle arrays in a color ink chip of a print head used in embodiment 1.

In more concrete terms, the printing apparatus of this embodiment uses a print head that differs from the construction of FIG. 4 in that additional nozzle arrays are used for the cyan ink and magenta ink, i.e., a total of four nozzle arrays are used for each of cyan and magenta inks (see FIG. 10).

The reason that four nozzle arrays are employed for only cyan and magenta, with two nozzles used for yellow and black, is as follows.

Different ink colors have different levels of visibility or visual identifiability for humans, and yellow has the lowest level among the four colors. When dots of the same size are compared, yellow dots are not as distinctive as those of other colors and give a less granular impression. Cyan and magenta have higher levels of visual identifiability than yellow, so that when a four-array arrangement is used to enhance the resolution, a higher print quality is obtained than that of the conventional two-array arrangement. For the yellow ink, however, the four-array arrangement cannot be expected to make any substantial contribution to image quality improvement.

The black ink has the highest visual identifiability of the four but, in color printing, is used less frequently and mostly used in an area with low brightness. Thus, if its resolution is lower than other colors, the black has little effect on the overall image impression. This embodiment, therefore, employs the four-array arrangement for cyan and magenta, that have large effects on the overall image impression and which can make a significant image quality improvement, and the conventional two-array arrangement for yellow and black that have little effect on the image quality. This minimizes a manufacturing cost increase and a print buffer capacity increase associated with the added nozzle arrays.

Embodiment 1

Now, one example of print head construction will be explained, which uses the four-array arrangement for each of cyan and magenta inks and the two-color arrangement for each of the remaining color inks.

FIG. 10 schematically shows an arrangement of nozzles of color inks in the color ink chip 1100.

The color ink chip of this invention has a plurality of nozzles for each of cyan, magenta, yellow and second black ink and, in each nozzle, a heater for generating a thermal energy to eject ink from the nozzle. For each color ink two nozzle arrays are provided. For the cyan, magenta and yellow ink, the two nozzle arrays are arranged symmetrically as described above. For the second black ink, a different arrangement is made, i.e., the nozzle arrays k1, k2 are arranged between the yellow ink nozzle array y2 and the magenta ink nozzle array m2.

Detailed construction of the color ink chip is as follows. One and the same silicon chip 1100 is formed with 10 grooves, each of which is formed with the above-described nozzles of each ink. That is, nozzles, ink paths communicating with the nozzles, heaters formed in a part of each ink path, and a common supply path communicating with the ink paths are formed in each groove.

Between the grooves in the chip 1100 are provided a drive circuit (not shown) for energizing the heaters. The heaters and the drive circuits are manufactured by the same process as the semiconductor deposition process. The ink paths and nozzles are formed of resin, further, the back of the silicon chip is formed with ink supply passages each of which supplies the associated ink to each groove.

Suppose that these ten grooves are, from left to right in the scan direction in the figure, a first groove 10001, a second groove 10002, a third groove 10003, a fourth groove 10004, a fifth groove 10005 and a sixth groove 10006. In this embodiment, the first groove 10001 and the sixth groove 10006 are supplied cyan ink; the second groove 10002 and the fifth groove 10005 are supplied magenta ink; the third groove 10003 is supplied yellow ink; and the fourth groove 10004 is supplied second black ink using a dye as a colorant.

On the far side of the first groove 10001 from the second groove is arranged a cyan ink nozzle array c1 made up of 64n nozzles (n is an integer equal to or larger than 1; e.g., n=4); and another cyan ink nozzle array c3 made up of 64n nozzles is arranged on the second groove side of the first groove 10001. On the first groove side of the second groove 10002 a magenta ink nozzle array m1 made up of 64n nozzles is arranged; and another magenta ink nozzle array m3 made up of 64n nozzles is arranged on the third groove side of the second groove 10002. A yellow ink nozzle array y1 having 64n nozzles is arranged on the second groove side of the third groove 10003; and another yellow ink nozzle array y2 having 64n nozzles is arranged on the fourth groove side of the third groove 10003. A dye black ink (second black ink) nozzle array k1 having 64n nozzles is arranged on the third groove side of the fourth groove 10004; and another dye black ink nozzle array k2 having 64n nozzles is arranged on the fifth groove side of the fourth groove 10004. Further, on the fourth groove side of the fifth groove 10005 a magenta ink nozzle array m4 made up of 64n nozzles is arranged; and another magenta ink nozzle array m2 made up of 64n nozzles is arranged on the sixth groove side of the fifth groove 10005. On the fifth groove side of the sixth groove 10006 a cyan ink nozzle array c4 made up of 64n nozzles is arranged; and another cyan ink nozzle array c2 made up of 64n nozzle is arranged on the far side of the sixth groove 10006 with respect to the fifth groove.

These nozzle arrays have their nozzles arranged at almost equal pitches. The nozzle arrays c1 and c2, m1 and m2, y1 and y2, k1 and k2 of the same ink colors are staggered from each other by one-half of the nozzle pitch in the subscan direction. This arrangement is made to secure the highest dot coverage of each pixel in one printing scan.

In this embodiment, additional two arrays are provided for cyan and magenta. These additional nozzle arrays c3, c4, m3, m4 have smaller ink ejection volumes than other nozzle arrays. Comparing C3 and C4 and comparing m3 and m4 shows that the nozzle arrays of the same ink colors are staggered by one-half of the nozzle pitch in the subscan direction.

Further, comparison between c1 and c3 and comparison between c2 and c4 shows that the arrays are staggered by ¼ the nozzle pitch in the subscan direction. This also applies to the relation between m1 and m3 and between m2 and m4.

That is, for cyan and magenta, there are twice as many nozzles as the remaining colors such as yellow. Further, examining the mutual positional relation between the nozzles of the four arrays c1, c2, c3, c4 and the mutual positional relation between the nozzles of the two arrays y1, y2 shows that cyan or magenta nozzles are arranged at twice as fine pitches as those of the remaining color nozzles such as yellow. Therefore, cyan and magenta have higher resolution than other colors such as yellow.

In the example print head shown in FIG. 10, the volume of each of ink droplets ejected from the nozzles of the nozzle arrays c1, c2, m1, m2, y1, y2, k1, k2 is relatively large, and the ink droplet volume ejected from each nozzle of the nozzle arrays c3, c4, m3, m4 is relatively small.

The print buffer is arranged as follows. The memory area is divided and managed so that the divided areas match the corresponding nozzle arrays of each ink color. That is, a cyan first print buffer is allocated to the cyan nozzle array c1, a magenta first print buffer is allocated to the magenta nozzle array m1, a yellow first print buffer is allocated to the yellow nozzle array y1, and a black first print buffer is allocated to the black nozzle array k1. Further, the black nozzle array k2 is assigned a black second print buffer, the yellow nozzle array y2 is assigned a yellow second print buffer, the magenta nozzle array m2 is assigned a magenta second print buffer, and the cyan nozzle array c2 is assigned a cyan second print buffer.

Then, if necessary, the cyan nozzle array c3 is assigned a cyan third print buffer, and the magenta nozzle array m3 is assigned a magenta third print buffer. The magenta nozzle array m4 is assigned a magenta fourth print buffer, and the cyan nozzle array c4 is assigned a cyan fourth print buffer.

In the configuration intended for a high resolution printing using multiple kinds of inks, this embodiment is also characterized in that the volume of print buffer to be set is optimized according to the print mode. The following description concerns a print mode that uses only cyan, magenta, yellow and black ink nozzle arrays in the color ink chip 1100 (FIG. 10) of the print head and does not use the black ink chip 1200 of pigment black ink.

This embodiment provides two color print modes that do not use a pigment black ink—a "high resolution print mode" intended for high image quality and a "normal print mode" giving priority to the print speed. In the high resolution print mode, all the nozzle arrays are used for cyan and magenta. That is, for cyan ink, four arrays c1, c2, c3, c4 are used; and for magenta ink, four arrays m1, m2, m3, m4 are used. In the normal print mode, only two nozzles are used for each color. That is, only c1 and c2 of the four cyan arrays and only m1 and m2 of the four magenta arrays are used, and the remaining arrays c3, c4, m3, m4 are not used. Since the print buffers associated with the out-of-operation nozzle arrays are not used, the memory area used decreases. A relation between the print mode switching and the print buffers will be described in the following.

Figure 11:
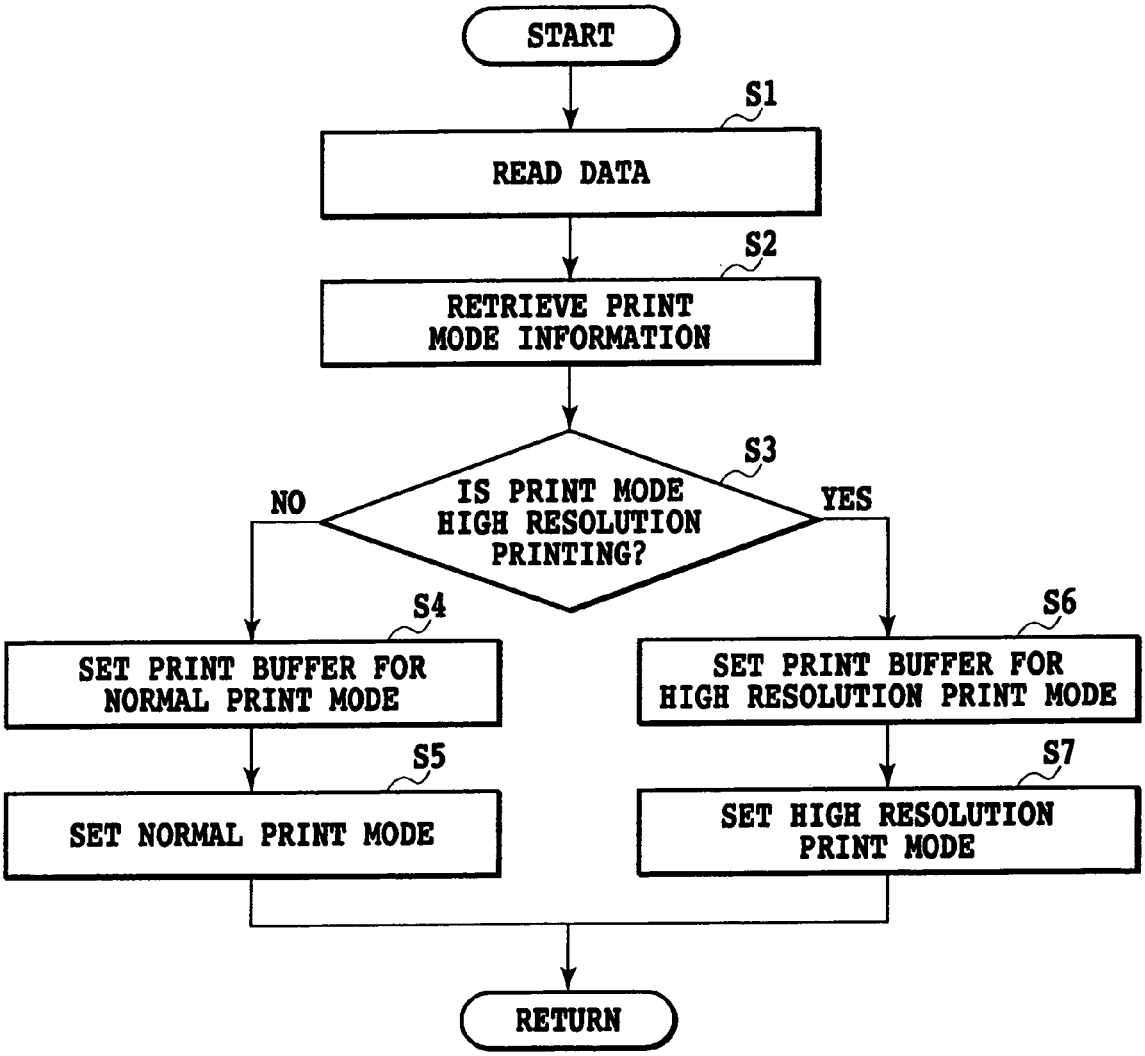
FIG. 11 is a control flow showing an example print buffer setting method used in embodiment 1.

FIG. 11 shows an example control flow for setting a print buffer according to print mode information. First, print data to be printed is read from a host computer (step 1). Next, print mode information is retrieved (step 2). Then, a check is made as to whether the print mode retrieved is a high resolution print mode (step 3). If the print mode is not the high resolution print mode, it is decided that the print mode is the normal print mode and a print buffer for the normal print mode is set (step 4). That is, for cyan and magenta, a third print buffer and a fourth print buffer are not set. Then, a normal print mode setting is made (step 5). If step 3 finds that the print mode is the high resolution print mode, a print buffer for high resolution print mode is set (step 6), followed by the setting of the high resolution print mode (step 7).

As described above, according to the print mode information, print buffers can be set independently of each other. With this control flow, the printing apparatus can make an appropriate print buffer setting according to the print mode selected, allowing for efficient use of a limited nonvolatile memory. Further, since two nozzle arrays are used for yellow and black, an increase in the size of the print buffers can be minimized, making it possible to map data in a nonvolatile memory of relatively small capacity. This in turn minimizes a cost increase in realizing the high resolution printing.

The use of this control flow allows both of the normal printing and the high resolution printing to be performed by increasing or decreasing the number of nozzle arrays used according to the print mode specified although the operations of the printing apparatus for these print modes are exactly the same.

In addition, since this embodiment can perform printing in either of the print modes without changing the drive frequency, the print speed does not change between the normal print mode and the high resolution print mode.

Generally, when performing a high resolution printing, a resulting change in the number of printing scans, the print medium feed accuracy and the printing operation timing can sharply reduce the print speed. With this invention, however, it is possible to perform the high resolution printing with a simple control without lowering the print speed.

Figure 12A:
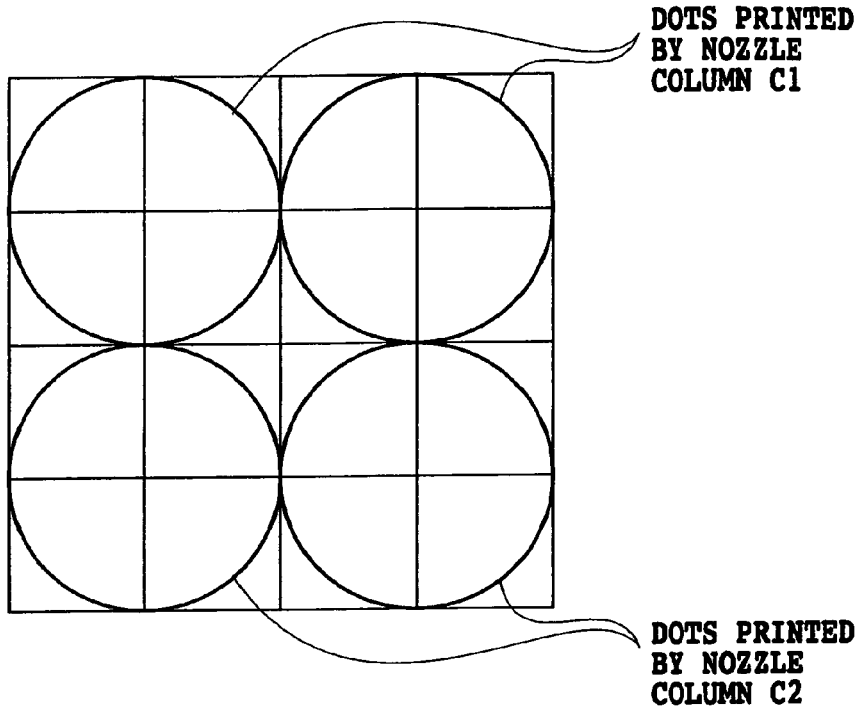
FIG. 12A is a schematic diagram showing how one pixel is formed by a plurality of dots ejected from the print head of FIG. 10 in a normal print mode.
Figure 12B:
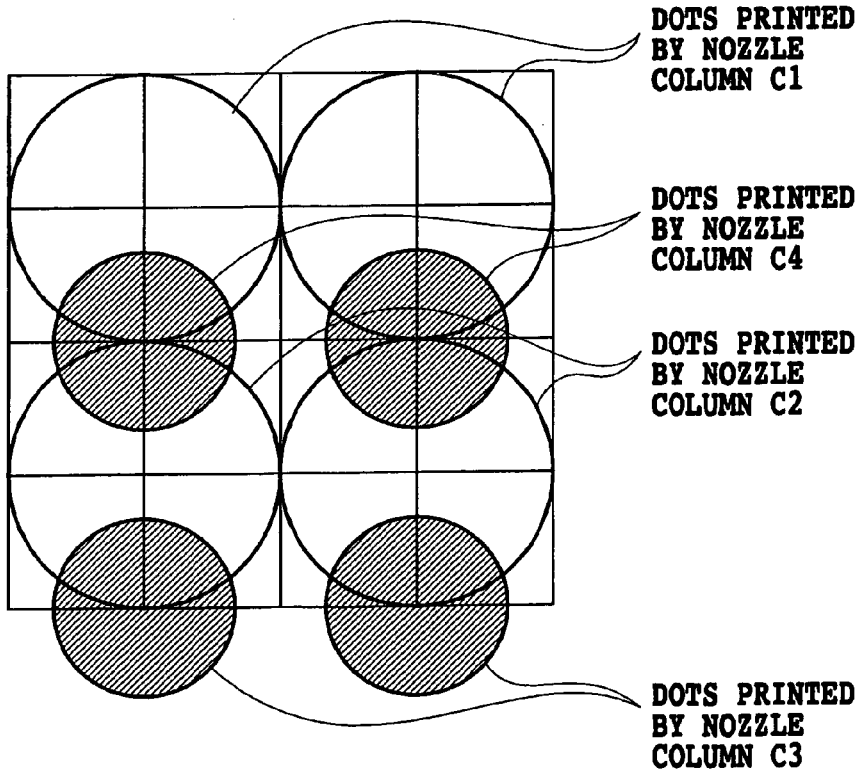
FIG. 12B is a schematic diagram showing how one pixel is formed by a plurality of dots ejected from the print head of FIG. 10 in a high resolution print mode.

FIGS. 12A and 12B show positions of dots formed by the print head of FIG. 10, FIG. 12A representing an example dot arrangement in the normal print mode, FIG. 12B representing an example dot arrangement in the high resolution print mode. FIG. 12A and FIG. 12B both show one pixel at the highest possible grayscale level.

As described above, ink droplets ejected from nozzles of the nozzle arrays c3, c4, m3, m4 of FIG. 10 are relatively small compared with those ejected from nozzles of the nozzle arrays c1, c2, m1, m2, y1, y2, k1, k2. Their dot sizes also are relatively small. FIG. 12B shows dots formed by the cyan ink nozzle arrays c1, c2 and the cyan ink nozzle arrays c3, c4.

Of the four dots applied to one pixel of FIG. 12A, upper two dots are printed by the nozzle array c1 and the lower two dots are printed by the nozzle array c2. In FIG. 12B, in addition to the four dots of FIG. 12A, two dots are applied from the nozzle array c4 and two dots are applied from the nozzle array c3. The dots formed by the nozzle array c4 and the dots formed by the nozzle array c3 are located at points deviated ¼ of the pixel from the dots printed by the nozzle arrays c1 and c2. This shifting results from the nozzle arrangement of the print head of FIG. 10 and is achieved not by the print medium feed control in the subscan direction but by the selection of the print head nozzle arrays used.

The printed dots can be arranged more precisely and densely in the subscan direction in the high resolution printing, so the high resolution printing is relatively advantageous in minimizing image degradations typically caused by variations in landing positions of printed dots.

Figure 13A:
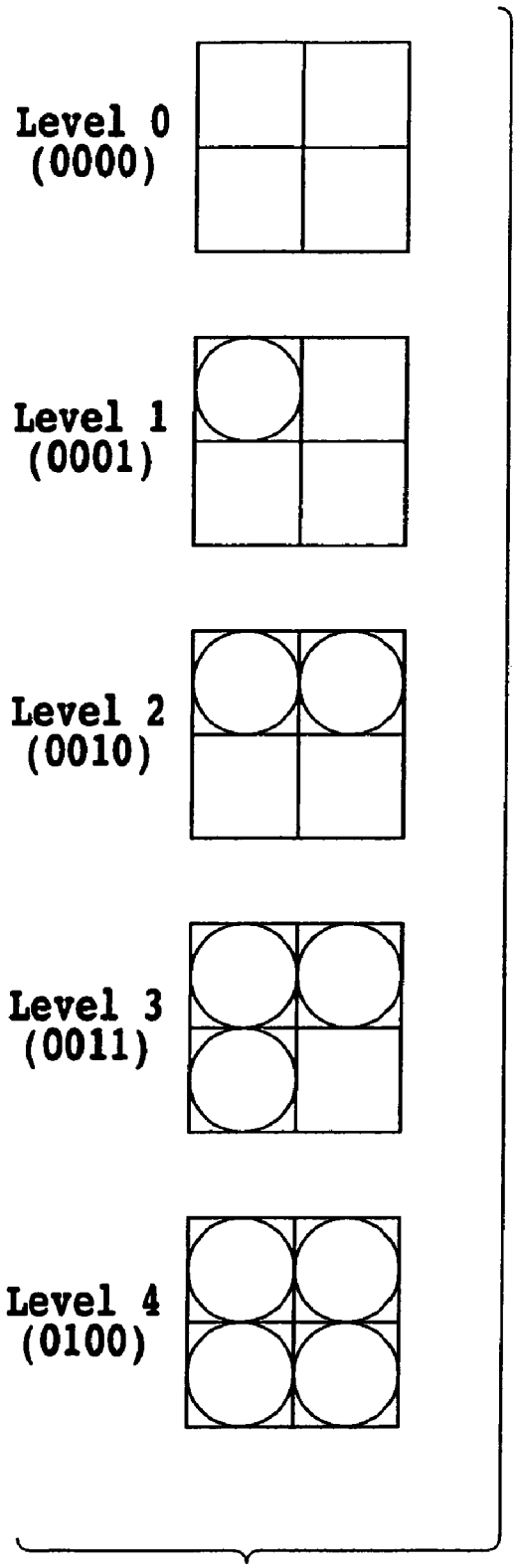
FIG. 13A is a schematic diagram showing how a gray scale level of one pixel composed of a plurality of dots ejected from the print head of FIG. 10 is changed in the normal print mode.
Figure 13B:
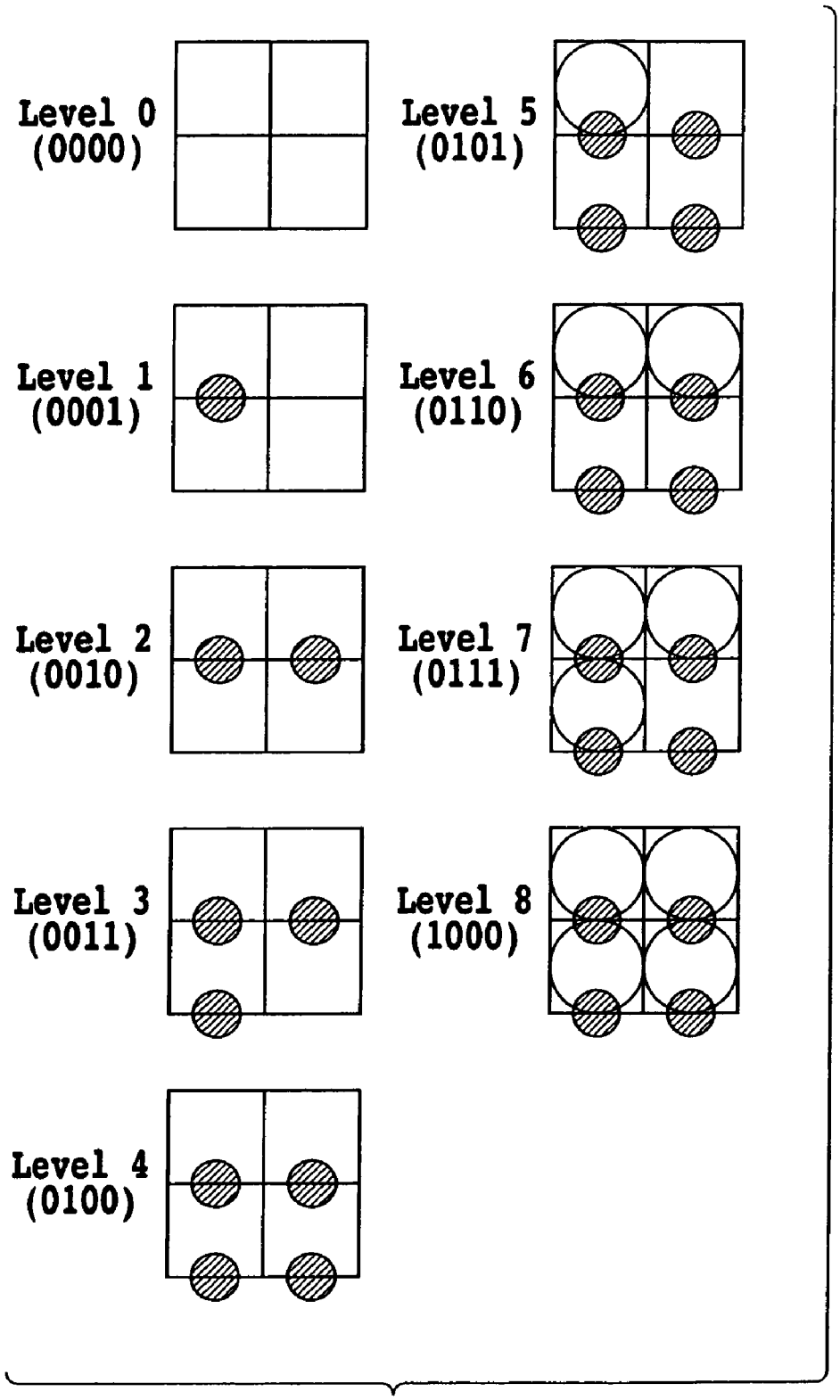
FIG. 13B is a schematic diagram showing how a gray scale level of one pixel composed of a plurality of dots ejected from the print head of FIG. 10 is changed in the high resolution print mode.

Next, an explanation about grayscale in each pixel during an actual image formation follows. FIGS. 13A and 13B schematically show grayscale level changes in the normal print mode and in the high speed print mode.

FIG. 13A shows an example of dot arrangements in a normal print mode representing five grayscale levels in one pixel. FIG. 13B shows an example of dot arrangements in a high resolution print mode representing nine grayscale levels in one pixel. In a grayscale range from level 1 to level 4, dots are formed using only the nozzle arrays c4 and c3. In a grayscale range from level 5 to level 8, additional dots are formed by the nozzle arrays c1 and c2. The nozzle arrays used change according to the grayscale level. Which nozzle arrays are used is controlled by the print data entered into the print buffers allocated to the associated nozzle arrays. In this embodiment, four print buffers are prepared for four nozzle arrays to ensure that appropriate print data is formed according to image data to be printed.

Here, an image printed in the high resolution print mode of FIG. 13B is explained. An image formed by nine grayscale levels of dots is characterized as follows. Areas of low grayscale levels are printed with relatively small ink dots ejected from the nozzle arrays c4 and c3. As the grayscale level increases, relatively large ink dots are added. Compared with FIG. 13A, it is apparent that this print mode offers a wider grayscale range. Particularly, at low grayscale levels an image is formed by small ink droplets so that finer tone representation can be made than the normal print mode.

Further, since the nozzle array c1 or c2 and the nozzle array c3 or c4 are deviated by ¼ the nozzle pitch, large dots from the nozzle array c1 or c2 and small dots from the nozzle array c3 or c4 do not overlap at the landing positions but are deviated ¼ the pitch in the subscan direction (column direction (nozzle arrangement direction)). As a result, finer tone representation can be realized even at relatively high grayscale levels.

Thus it is seen from the above that there is a correlation between grayscale and resolution. This characteristic is not a mere aspect of specifications but an important characteristic representing the feature of the print head of this invention. In other words the print head of this invention offers both a wide range of tone and a high resolution.

Further, as described above, the print head of this invention provides additional nozzle arrays for cyan and magenta inks for high resolution printing. For yellow ink, a high resolution printing is not provided because, from the color engineering point of view, yellow is not as recognizable as other colors and its wide grayscale range does not effectively contribute to the improvement of image quality. Considering the limited capacity of nonvolatile memory and the cost, the yellow ink is used at the same low resolutions as before.

Figure 14:
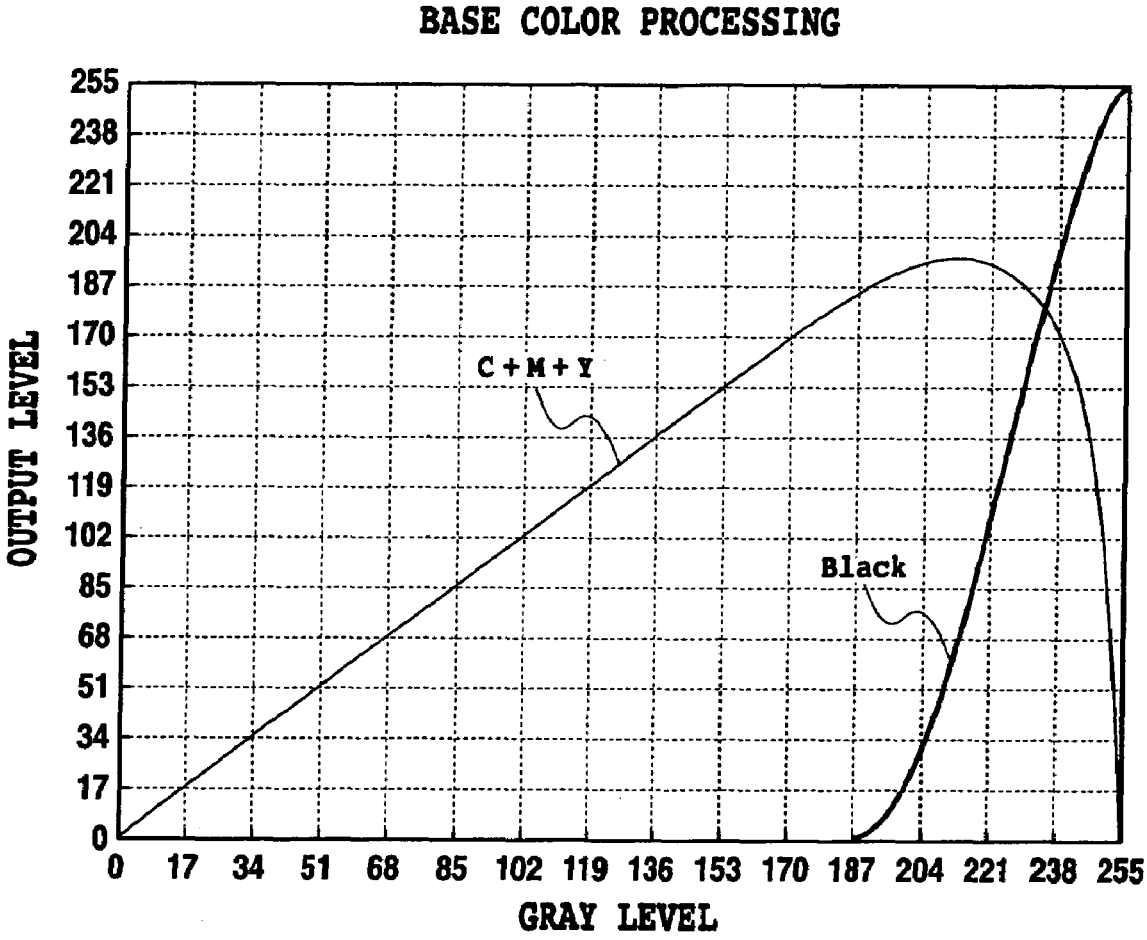
FIG. 14 is a schematic diagram explaining a process color black used in embodiment 1.

What has been described above similarly applies to the second black ink. In general image design, at a low grayscale level an image is formed by using a process color black produced by mixing cyan, magenta and yellow and, from a certain density upward, applying the black ink. An example of image formation using a process color black is shown in FIG. 14.

In the case of black ink, the wide grayscale range does not contribute substantially to the improvement of image quality. Rather, an aspect of the highest possible density that affects a contrast of image is important for the black ink. Therefore, the second black is used at the same low resolutions as before.

As described above, a printing apparatus can be provided which meets the requirements of both a wide tonal range and a high resolution by using the print head of FIG. 10, i.e., a print head with a nozzle mechanism in which a plurality of nozzle arrays are allocated to a plurality of different colorants and arrayed in the scan direction and in which the number of nozzle arrays and the nozzle pitch are changed according to the associated colorant to eject different volumes of ink from different nozzle arrays onto the print medium. More specifically, by printing at a high resolution only those colorants that make significant contributions to image quality improvement, an excellent cost effectiveness is achieved for both the print head and the printing apparatus.

A more detailed explanation is given as to the effect produced by the arrangement in which dots formed by the adjoining nozzle arrays of the same color (e.g., c1 and c3) are deviated ¼ the nozzle pitch from each other.

Figure 15:
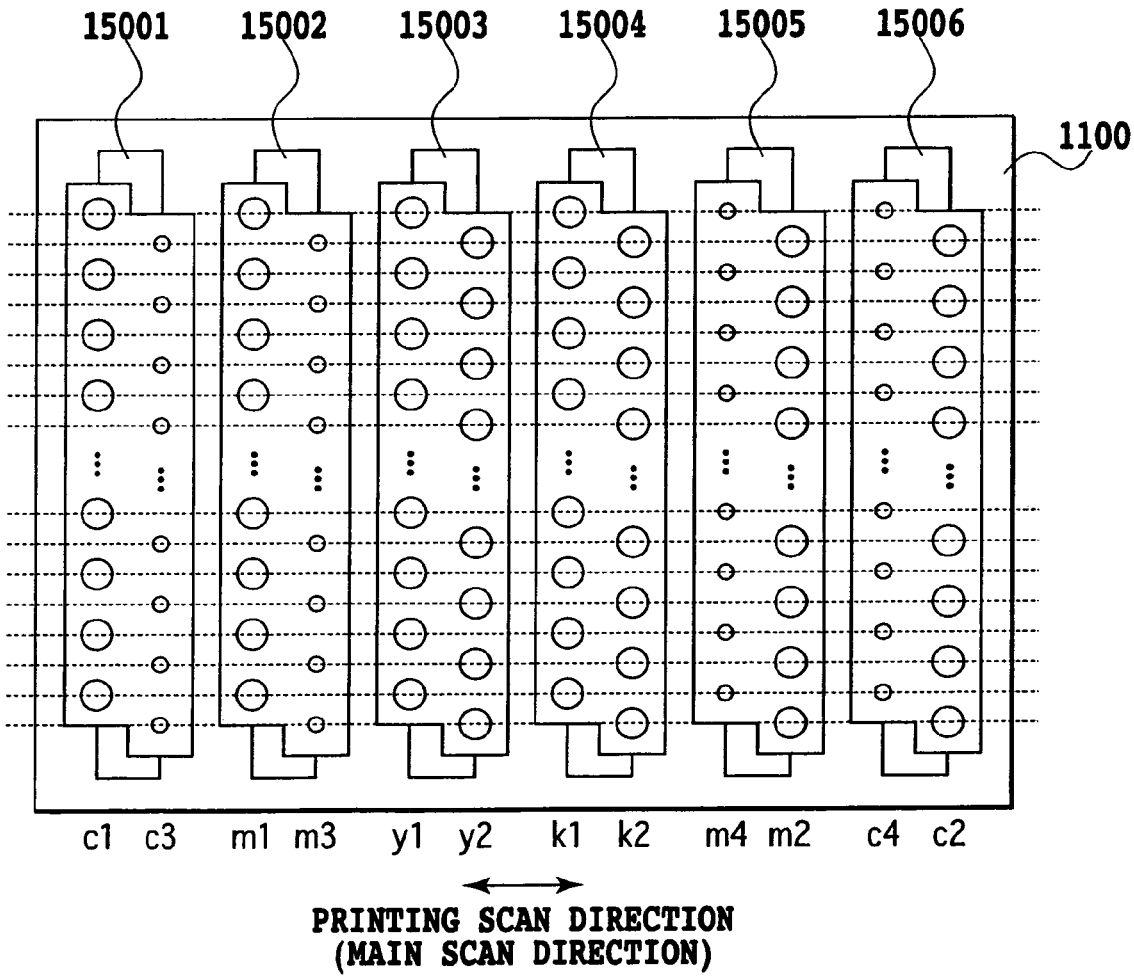
FIG. 15 illustrates an example arrangement of nozzle arrays in a color ink chip of a conventional print head.

FIG. 15 shows a print head for comparison in which two adjoining nozzle arrays are staggered ½ the nozzle pitch.

In FIG. 15, it is assumed that ten grooves are, from left to right in the scan direction, a first groove 15001, a second groove 15002, a third groove 15003, a fourth groove 15004, a fifth groove 15005 and a sixth groove 15006. As in the case of FIG. 10, a cyan ink is supplied to the first groove 15001 and sixth groove 15006; a magenta ink is supplied to the second groove 15002 and fifth groove 15005; a yellow ink is supplied to the third groove 15003; and a second black ink using a dye colorant is supplied to the fourth groove 15004.

On the far side of the first groove 15001 from the second groove is arranged a cyan ink nozzle array c1 made up of 64n nozzles (n is an integer equal to or larger than 1; e.g., n=4); and another cyan ink nozzle array c3 made up of 64n nozzles is arranged on the second groove side of the first groove 15001. On the first groove side of the second groove 15002 a magenta ink nozzle array m1 made up of 64n nozzles is arranged; and another magenta ink nozzle array m3 made up of 64n nozzles is arranged on the third groove side of the second groove 15002. A yellow ink nozzle array y1 having 64n nozzles is arranged on the second groove side of the third groove 15003; and another yellow ink nozzle array y2 having 64n nozzles is arranged on the fourth groove side of the third groove 15003. A dye black ink (second black ink) nozzle array k1 having 64n nozzles is arranged on the third groove side of the fourth groove 15004; and another dye black ink nozzle array k2 having 64n nozzles is arranged on the fifth groove side of the fourth groove 15004. Further, on the fourth groove side of the fifth groove 15005 a magenta ink nozzle array m4 made up of 64n nozzles is arranged; and another magenta ink nozzle array m2 made up of 64n nozzles is arranged on the sixth groove side of the fifth groove 15005. On the fifth groove side of the sixth groove 15006 a cyan ink nozzle array c4 made up of 64n nozzles is arranged; and another cyan ink nozzle array c2 made up of 64n nozzle is arranged on the far side of the sixth groove 15006 with respect to the fifth groove.

These nozzle arrays have their nozzles arranged at almost equal pitches. The nozzle arrays c1 and c2, m1 and m2, y1 and y2, k1 and k2 of the same ink colors are staggered from each other by one-half the nozzle pitch in the subscan direction. This arrangement is made to secure the highest dot coverage of each pixel in one printing scan. Further, the nozzle arrays c3 and c4, m3 and m4 of the same ink colors are similarly staggered from each other by one-half the nozzle pitch in the subscan direction. In the combination of c1 and c2 and a combination of c3 and c4, the nozzle arrays assume the same positions in the subscan direction. As in the case of FIG. 10, the volume of each of ink droplets ejected from the nozzles of the nozzle arrays c1, c2, m1, m2, y1, y2, k1, k2 is relatively large, and the ink droplet volume ejected from each nozzle of the nozzle arrays c3, c4, m3, m4 is relatively small.

For cyan and magenta, as with the print head of embodiment 1 (FIG. 10), one of the adjoining nozzle arrays has large nozzles and the other small nozzles. However, the two adjoining nozzle arrays of the same color are staggered ½ the nozzle pitch, rather than ¼ the nozzle pitch. That is, center lines of the c3 nozzles match those of the c2 nozzles and center lines of the c4 nozzles match those of the c1 nozzles. Therefore, the same tonal change as shown in FIG. 13B can be realized but with the direction of change being a raster direction.

That is, the grayscale level change in FIG. 13B is realized by increasing the number of landing dots in the subscan direction or in the column direction. In the print head of the nozzle array arrangement as shown in FIG. 15, since the center lines of nozzles of c1 and c4 are identical, dots from both nozzle arrays are applied to the same raster. Thus, the tonal change similar to FIG. 13B can be realized by increasing the number of landing dots in the raster direction.

Figure 16A:
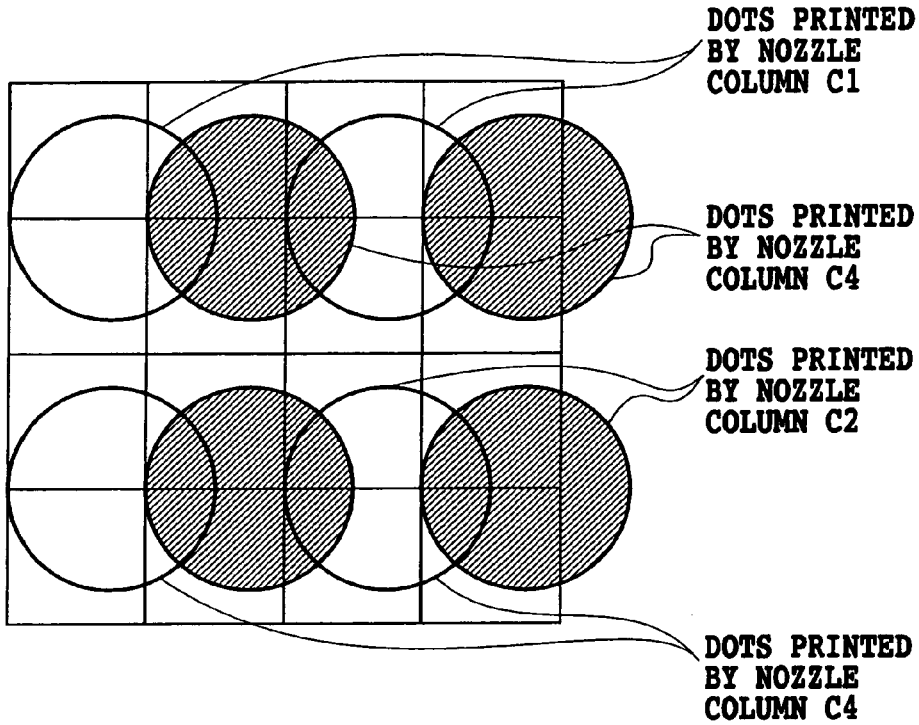
FIG. 16A is a schematic diagram showing a pixel formed by a plurality of dots ejected from the print head of FIG. 15.

FIG. 16A shows a dot arrangement in one pixel made up of eight dots formed by the nozzle array configuration of FIG. 15, with small dots shown to the same size as large dots for simplicity. Dots printed by the nozzle array c1 and dots printed by the nozzle array c4 combine to form one raster. Dots printed by the nozzle array c2 and dots printed by the nozzle array c3 combine to form one raster. In this configuration where dots are arrayed side by side in the raster direction, one raster in one pixel is formed by matching the ejection timings of ink droplets from the paired two nozzle arrays. Increasing the number of dots arrayed in the raster direction can be achieved not only by using two nozzle arrays c1, c4 but also by using only c1 array and increasing the ejection frequency of the print head.

Another method involves increasing the number of dots in the column direction, i.e., filling a space between the two rasters with additional dots. This requires increasing the number of printing scans and changing the subscan direction feed control in the printing apparatus body. This in turn requires a more accurate control and a more precise driving of the apparatus, making a control program complicated. This method is therefore not desirable.

Figure 16B:
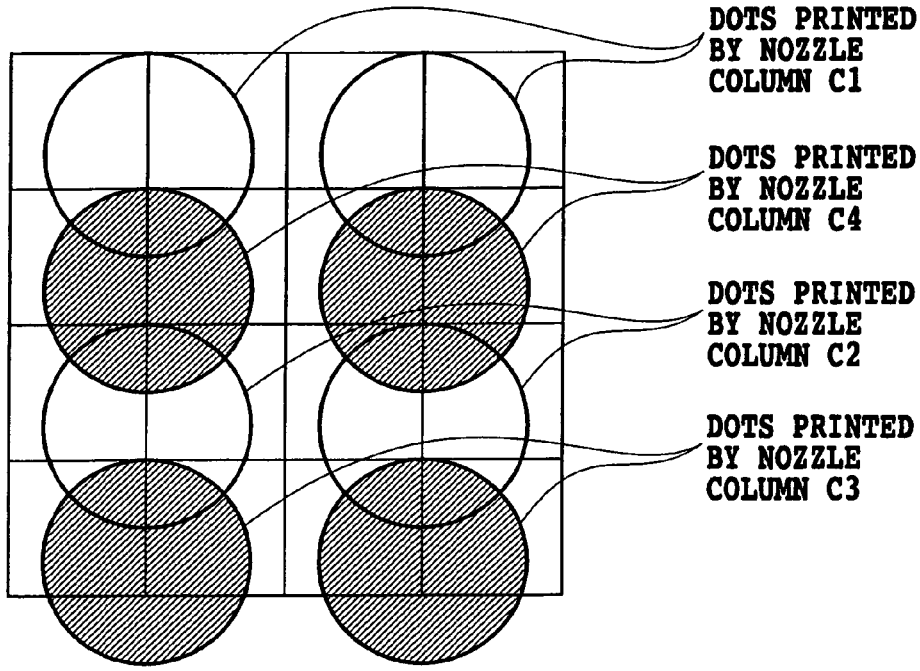
FIG. 16B is a schematic diagram showing a pixel formed by a plurality of dots ejected from the print head of FIG. 10.

FIG. 16B shows a dot arrangement in one pixel formed by the nozzle array configuration of FIG. 10, with small dots shown to the same size as large dots for simplicity. As can be seen from the figure, one pixel is made up of eight dots as in FIG. 16A but individual rasters are formed by different nozzle arrays. In the column direction, each dot column is formed by a combination of four nozzle arrays. This can be realized because the adjoining nozzle arrays c1 and c3 are staggered ¼ the nozzle pitch.

In the dot arrangement shown in FIG. 16B, adding new dots in the raster direction to increase the number of dots, i.e., filling a gap between the two dot columns with additional dots, can be realized by increasing the ejection frequency of the print head. Alternatively, this may be realized by increasing the number of printing scans and controlling the ejection timing for each printing scan. That is, if the same images are to be printed, the print head of this embodiment, when compared with the print head with the nozzle configuration of FIG. 15, has an improved flexibility for extension and thus can realize a wide range of resolution specifications from low to high resolution without making significant changes in print head manufacturing devices. The print head configuration of this embodiment makes it easy to deal with changes in production conditions.

Embodiment 2

In the head configuration of embodiment 1 (FIG. 10), the nozzles making up the nozzle arrays c3, c4, m3, m4 have a small diameter to form small dots. This invention can also be accomplished by using large-diameter nozzles to form large dots.

Figure 17:
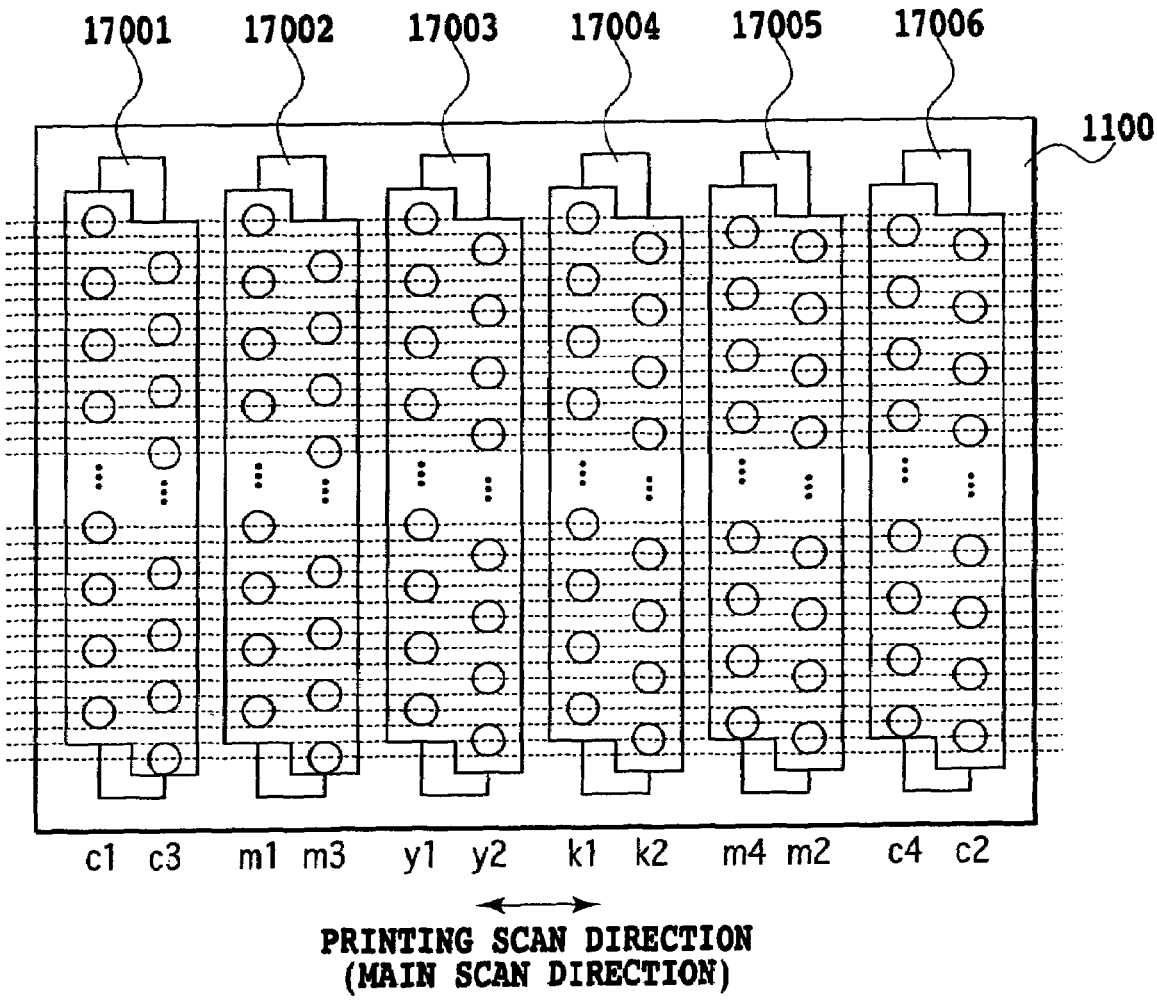
FIG. 17 is a schematic diagram showing an example arrangement of nozzle arrays in a color ink chip of a print head used in embodiment 2.

FIG. 17 shows an example print head with all nozzle arrays having nozzles of the same diameter.

In FIG. 17, detailed explanations about the nozzle arrays are omitted as they are almost the same as those of FIG. 10.

As explained in embodiment 1, it is preferable to shift the combination of nozzle arrays c1, c2 from the combination of nozzle arrays c3, c4 by ¼ the nozzle pitch. In FIG. 10 or FIG. 17, the adjoining nozzle arrays c1 and c3 or nozzle arrays c2 and c4 are staggered by ¼ the nozzle pitch. The effect produced by satisfying this relation between the adjoining nozzle arrays is detailed below.

Figure 18:
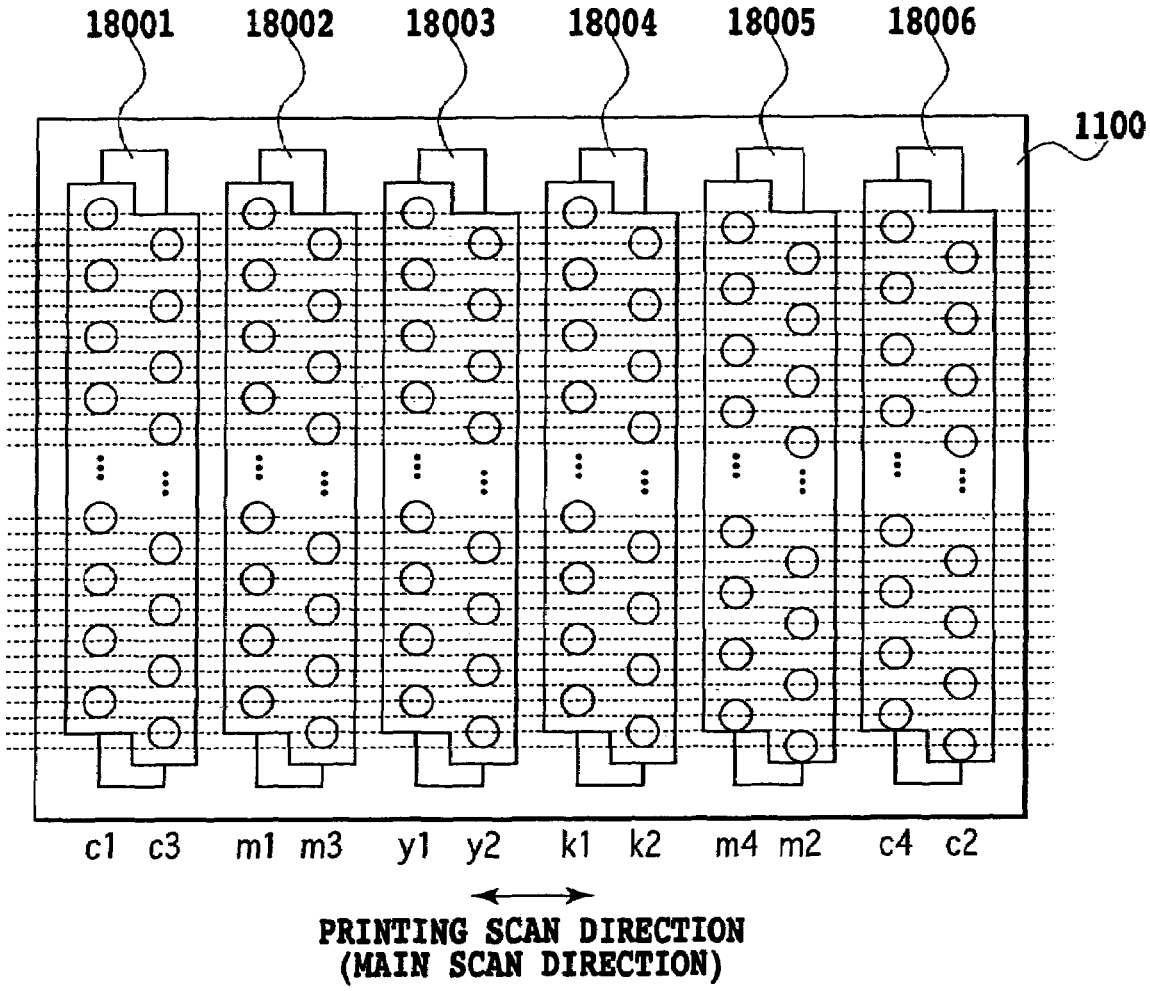
FIG. 18 illustrates an example arrangement of nozzle arrays in a color ink chip of a conventional print head.

FIG. 18 shows an example print head for comparison with the print head of FIG. 17. In FIG. 18 detailed descriptions of the nozzle arrays are omitted as they are almost similar to those of FIG. 10. The print head of FIG. 18 differs from the print head of FIG. 17 in the nozzle array combination for each colorant and the nozzle array arrangement. In FIG. 17, the paired nozzle arrays c1, c2, m1, m2, y1, y2, k1, k2 of the same ink color are staggered one-half the nozzle pitch in the subscan direction. The nozzle arrays c3, c4, m3, m4 are similarly arranged, i.e., the paired nozzle arrays of the same color are staggered one-half the nozzle pitch in the subscan direction. Further, the combination of nozzle arrays c1, c2 and the combination of nozzle arrays c3, c4 are staggered ¼ the nozzle pitch in the subscan direction.

In the print head of FIG. 18, the paired nozzle arrays c1, c3, m1, m3, y1, y2, k1, k2 of the same ink color are staggered one-half the nozzle pitch in the subscan direction. The nozzle arrays c2, c4, m2, m4 are similarly arranged, i.e., the paired nozzle arrays of the same color are staggered one-half the nozzle pitch in the subscan direction. The combination of nozzle arrays c1, c3 and the combination of nozzle arrays c2, c4 are staggered ¼ the nozzle pitch in the subscan direction.

The difference between the print heads of FIG. 17 and FIG. 18 is the manner in which the paired nozzle arrays are staggered. The print head of FIG. 17 is so arranged that the adjoining nozzle arrays (e.g., c1 and c3) form adjacent rasters. The print head of FIG. 18 is so arranged that adjacent rasters are formed by nozzle arrays located far from each other in the printing scan direction (e.g., c1 and c4). If dots are formed in an ideal condition, the dot arrangement such as shown in FIG. 16B can be realized by either of the nozzle array arrangement. However, if dot landing positions are deviated by external disturbances, such as errors in printing scan precision, print head mounting precision and print head manufacturing precision, as when a printing is performed at an angle to the printing scan direction, the difference in the nozzle array arrangement may greatly affect an image being printed.

Figure 19A:
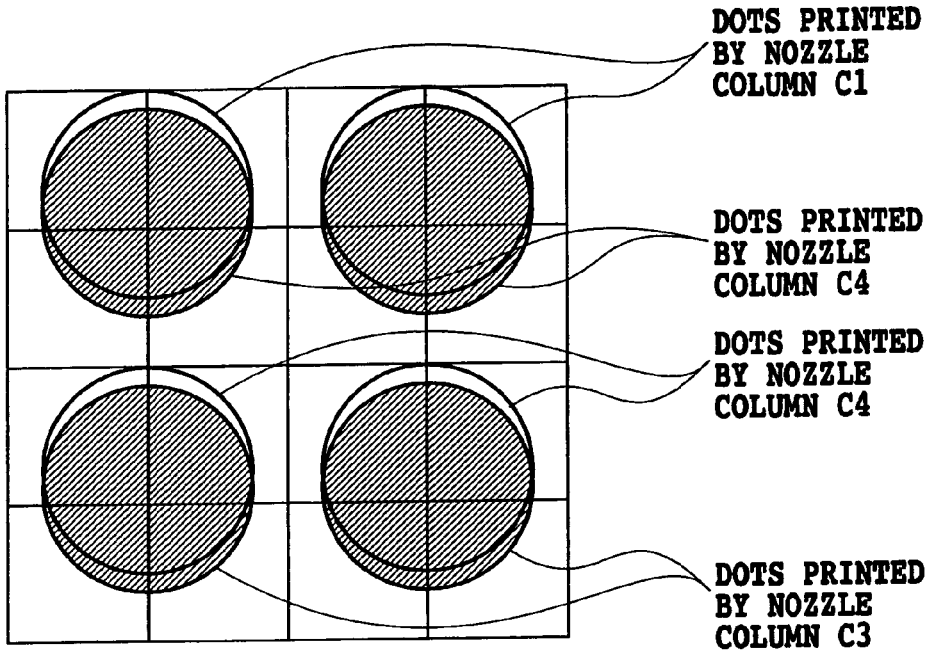
FIG. 19A is a schematic diagram showing a pixel formed by a plurality of dots ejected from the print head of FIG. 18.
Figure 19B:
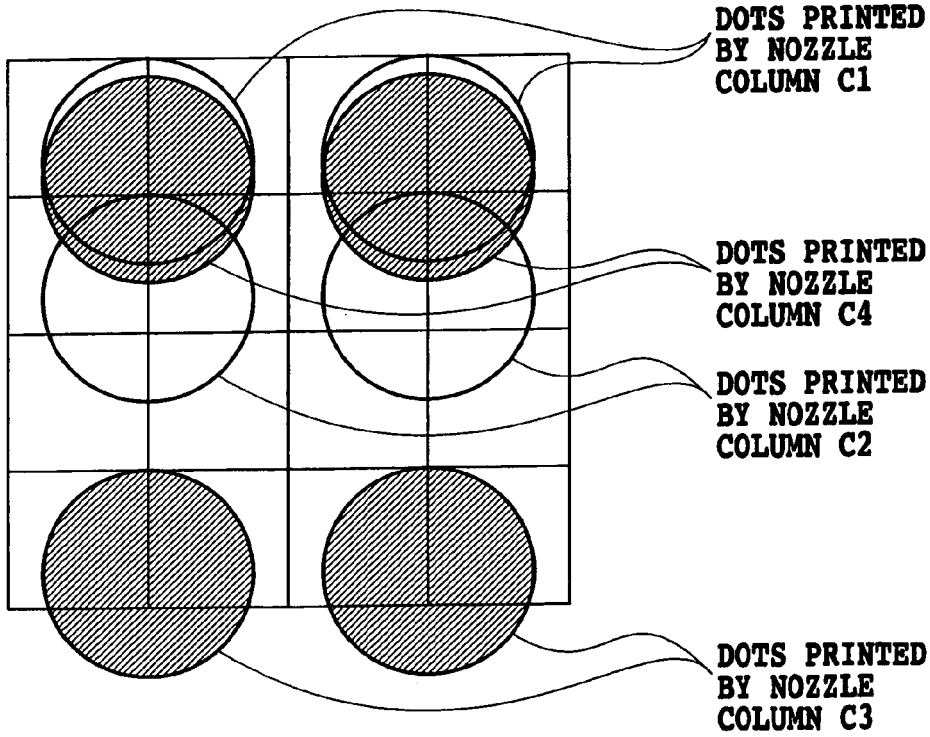
FIG. 19B is a schematic diagram showing a pixel formed by a plurality of dots ejected from the print head of FIG. 17.

FIG. 19A and FIG. 19B show example cases where the aforementioned dot landing deviations have occurred. FIG. 19A shows dots formed by the print head of FIG. 18, with a particular raster deviated ¼ of one pixel. Here, dots printed by nozzle arrays c2, c3 are deviated from the nozzle arrays c1, c3, leaving the dots printed by the nozzle arrays c1 and c4 almost overlapping each other. Further, dots formed by the nozzle arrays c2 and c3 almost overlap each other. Thus, it can be said that one pixel is formed nearly by two nozzle arrays.

FIG. 19B shows dots formed by the print head of FIG. 17, with a particular raster deviated ¼ of one pixel. Here, dots printed by nozzle arrays c2, c3 are deviated from the nozzle arrays c1, c3, leaving the dots printed by the nozzle arrays c1 and c4 almost overlapping each other. As a result, one pixel can be said to be formed by nearly three nozzle arrays. The print head of FIG. 17 is obviously more advantageous in coping with the dot landing deviations caused by external disturbances. In other words, if dots from one nozzle array should land deviated from ideal landing positions, the print head configuration of FIG. 17 can more effectively minimize a reduction in the dot coverage of a particular area than can the print head configuration of FIG. 18. These differences can arise partly from the different nozzle arrangements of the print heads and also from the fact that the image quality degradation caused by dot landing deviations can be reduced more effectively by using nozzle arrays located as close to each other as possible to form adjacent rasters than by using nozzle arrays separated far apart in the printing scan direction.

As described above, the use of the print head of FIG. 17, i.e., a print head with a nozzle mechanism that uses nozzle arrays arranged close to each other to form adjacent rasters, can provide a printing apparatus that is hardly affected by dot landing deviations caused by external disturbances, such as errors in printing scan precision, print head mounting precision and print head manufacturing precision.

With this invention, a printing apparatus can be provided which meets the requirements of both a wide tonal range and a high resolution by using a print head with a nozzle mechanism in which a plurality of nozzle arrays are allocated to a plurality of different colorants and arrayed in the scan direction and in which the number of nozzle arrays and the nozzle pitch are set for the associated colorant to eject different volumes of ink from different nozzle arrays onto the print medium. More specifically, by printing at a high resolution only those colorants that make significant contributions to image quality improvement, an excellent cost effectiveness is achieved for both the print head and the printing apparatus.

As a result, this invention will in the future developmentally reduce a research and development cost in the print head production and a manufacturing line development cost, thus allowing the printing apparatus that meets the requirements of both a wide grayscale range printing and a high resolution printing to be introduced into the market at lower cost in a shorter period.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

This application claims priority from Japanese Patent Application No. 2004-136675 filed Apr. 30, 2004, which is hereby incorporated by reference herein.

What is claimed is:

1. A printing apparatus for forming an image on a print medium by scanning a print head over the print medium in a scan direction different from the nozzle arrangement direction to apply a plurality of colorants to the print medium, the print head having a plurality of nozzle arrays arranged in the scan direction, two or more of the nozzle arrays being allocated to each of the colorants, the number of nozzle arrays allocated to one colorant differing depending on the colorant, each of the nozzle arrays having a plurality of nozzles arrayed at a predetermined pitch, comprising:

mode selection means to switch between a first print mode and a second print mode to perform a higher resolution printing that the first print mode; and nozzle drive control means to control operations of the nozzles according to the mode selected by the mode selection means, wherein an interval between nozzles in nozzle arrays allocated to a colorant that is allocated with a greater number of nozzle arrays than at least one other colorant is narrower than an interval between nozzles in nozzle arrays allocated to at least one other colorant, wherein, for the colorant allocated with a greater number of nozzle arrays than at least one other colorant, the nozzle drive control means uses in the first print mode only a particular one of the two or more nozzle arrays allocated to the colorant and, in the second print mode, uses all of the two or more nozzle arrays allocated to the colorant, wherein the nozzles in a plurality of nozzle arrays allocated to one and the same colorant form dots at different printing positions in the nozzle arrangement direction, and wherein an interval between dots which are capable of being printed by a first plurality of nozzle arrays allocated to a given colorant, the first plurality of nozzle arrays having a greater number of nozzle arrays, is narrower than an interval between dots which are capable of being printed by a second plurality of nozzle arrays allocated to another colorant, the second plurality of nozzle arrays having a smaller number of nozzle arrays.

2. A printing apparatus according to claim 1, wherein nozzles affayed in one of the nozzle arrays allocated to a colorant allocated with a greater number of nozzle arrays than at least one other colorant apply a smaller volume of the colorant to the print medium than nozzles of at least one of the other nozzle arrays.

3. A printing apparatus according to claim 1, wherein, for the colorant allocated with a greater number of nozzle arrays than at least one other colorant, the nozzle array used in the first print mode by the nozzle drive control means has nozzles that apply a larger volume of the colorant than nozzles of the other nozzle arrays of the same colorant.

4. A printing apparatus according to claim 1, wherein the colorant allocated with a greater number of nozzle arrays than at least one other colorant is cyan or magenta.

5. A printing apparatus according to claim 1, wherein the colorants are inks and the nozzles eject the ink onto the print medium for printing.

6. A printing method using a printing apparatus, wherein the printing apparatus forms an image on a print medium by scanning a print head over the print medium in a scan direction different from the nozzle arrangement direction to apply a plurality of colorants to the print medium, wherein the print head has a plurality of nozzle arrays arranged in the scan direction, two or more of the nozzle arrays being allocated to each of the colorants, the number of nozzle arrays allocated to one colorant differing depending on the colorant, each of the nozzle arrays having a plurality of nozzles arrayed at a predetermined pitch, wherein the nozzles in a plurality of nozzle arrays allocated to one and the same colorant form dots at different printing positions in the nozzle arrangement direction, and wherein an interval between dots which are capable of being printed by a first plurality of nozzle arrays allocated to a given colorant, the first plurality of nozzle arrays having a greater number of nozzle arrays, is narrower than an interval between dots which are capable of being printed by a second plurality of nozzle arrays allocated to another colorant, the second plurality of nozzle arrays having a smaller number of nozzle arrays, the printing method comprising:

a mode selection step to switch between a first print mode and a second print mode for performing a higher resolution printing than the first print mode; and a nozzle drive control step to control operations of the nozzles according to the mode selected by the mode selection step, wherein, for a colorant allocated with a greater number of nozzle arrays than at least one other colorant, the nozzle drive control step uses in the first print mode only a particular one of the two or more nozzle arrays allocated to the colorant and, in the second print mode, uses all of the two or more nozzle arrays allocated to the colorant.

7. A printing method according to claim 6, wherein the nozzle drive control step uses in the second print mode the nozzles of a combination of the two or more nozzle arrays allocated to the colorant.

8. A printing method according to claim 7, wherein an image printed in the second print mode has a resolution in a direction different from the direction of the print head scan over the print medium that is higher than a resolution of an image printed in the first print mode in the direction of the print head scan over the print medium.

9. A printing apparatus for forming an image on a print medium by scanning a print head over the print medium in a scan direction different from the nozzle arrangement direction to apply a plurality of colorants to the print medium, the print head having a plurality of nozzle arrays arranged in the scan direction, two or more of the nozzle arrays being allocated to each of the colorants, the number of nozzle arrays allocated to one colorant differing depending on the colorant, each of the nozzle arrays having a plurality of nozzles arrayed at a predetermined pitch, comprising:

mode selection means to switch between a first print mode and a second print mode to perform a higher resolution printing than the first print mode; and nozzle drive control means to control operations of the nozzles according to the mode selected by the mode selection means, wherein an interval between nozzles in nozzle arrays allocated to a colorant that is allocated with a greater number of nozzle arrays than at least one other colorant is narrower than an interval between nozzles in nozzle arrays allocated to at least one other colorant, wherein, for the colorant allocated with a greater number of nozzle arrays than at least one other colorant, the nozzle drive control means uses in the first print mode only a particular one of the two or more nozzle arrays allocated to the colorant and, in the second print mode, uses only those of the two or more nozzle arrays allocated to the colorant which are not used in the first print mode, wherein the nozzles in a plurality of nozzle arrays allocated to one and the same colorant form dots at different printing positions in the nozzle arrangement direction, and wherein an interval between dots which are capable of being printed by a first plurality of nozzle arrays allocated to a given colorant, the first plurality of nozzle arrays having a greater number of nozzle arrays, is narrower than an interval between dots which are capable of being printed by a second plurality of nozzle arrays allocated to another colorant, the second plurality of nozzle arrays having a smaller number of nozzle arrays.

10. A printing apparatus according to claim 9, wherein nozzles arrayed in one of the nozzle arrays allocated to a colorant allocated with a greater number of nozzle arrays than at least one other colorant apply a smaller volume of the colorant to the print medium than nozzles of at least one of the other nozzle arrays.

11. A printing method using a printing apparatus, wherein the printing apparatus forms an image on a print medium by scanning a print head over the print medium in a scan direction different from the nozzle arrangement direction to apply a plurality of colorants to the print medium, wherein the print head has a plurality of nozzle arrays arranged in the scan direction, two or more of the nozzle arrays being allocated to each of the colorants, the number of nozzle arrays allocated to one colorant differing depending on the colorant, each of the nozzle arrays having a plurality of nozzles arrayed at a predetermined pitch, wherein the nozzles in a plurality of nozzle arrays allocated to one and the same colorant form dots at different printing positions in the nozzle arrangement direction, and wherein an interval between dots which are capable of being printed by a first plurality of nozzle arrays allocated to a given colorant, the first plurality of nozzle arrays having a greater number of nozzle arrays, is narrower than an interval between dots which are capable of being printed by a second plurality of nozzle arrays allocated to another colorant, the second plurality of nozzle arrays having a smaller number of nozzle arrays, the printing method comprising:

a mode selection step to switch between a first print mode and a second print mode for performing a higher resolution printing than the first print mode; and a nozzle drive control step to control operations of the nozzles according to the mode selected by the mode selection step, wherein, for a colorant allocated with a greater number of nozzle arrays than at least one other colorant, the nozzle drive control step uses in the first print mode only a particular one of the two or more nozzle arrays allocated to the colorant and, in the second print mode, uses only those of the two or more nozzle arrays allocated to the colorant that are not used in the first print mode.

* * * * *

UNITED STATES PATENT AND TRADEMARK OFFICE

CERTIFICATE OF CORRECTION

PATENT NO. : 7,377,619 B2
APPLICATION NO. : 11/114167
DATED : May 27, 2008
INVENTOR(S) : Takahashi et al.

It is certified that error appears in the above-identified patent and that said Letters Patent is hereby corrected as shown below:

COLUMN 1:
Line 67, “resulted.” should read --results.--.

COLUMN 7:
Line 51, “fro” should read --for--.

COLUMN 25:
Line 46, “that” should read --than--.
Line 54, “to” should read --to the--.

COLUMN 26:
Line 9, “affayed” should read --arrayed--.

COLUMN 27:
Line 25, “to” should read --to the--.

Signed and Sealed this

Third Day of March, 2009

JOHN DOLL
*Acting Director of the United States Patent and Trademark Office*